US006584711B1

(12) United States Patent
Nakamura

(10) Patent No.: US 6,584,711 B1
(45) **Date of Patent: *Jul. 1, 2003**

(54) METHOD AND APPARATUS FOR SPREADING A RECTANGULAR SHEET OF FABRIC

(75) Inventor: Yoshizou Nakamura, Kagawa (JP)

(73) Assignee: Tokai Co., Ltd., Takamatu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 08/669,382

(22) PCT Filed: Oct. 1, 1995

(86) PCT No.: PCT/JP95/00021

§ 371 (c)(1),
(2), (4) Date: May 28, 1998

(87) PCT Pub. No.: WO96/21765

PCT Pub. Date: Jul. 18, 1996

(51) Int. Cl.[7] ..... D06F 67/04
(52) U.S. Cl. ..... 38/143
(58) Field of Search ..... 38/143; 112/117; 198/375, 376; 271/3.08, 3.24, 98, 226

(56) References Cited

U.S. PATENT DOCUMENTS 4,313,269 A * 2/1982 Van Rumpt et al. ..... 38/143
4,979,860 A 12/1990 Ueda
4,979,868 A 12/1990 Ueda
5,168,645 A * 12/1992 Robin et al. ..... 38/143
6,021,725 A * 2/2000 Resta ..... 112/117

FOREIGN PATENT DOCUMENTS

EP A1 0 272 368 6/1988
GB 2219313 * 12/1989 ..... 38/143

* cited by examiner

*Primary Examiner*—Ismael Izaguirre
(74) *Attorney, Agent, or Firm*—Armstrong, Westerman & Hattori, LLP

(57) ABSTRACT

Cleaning of dirty rectangular sheets of fabric must proceed through such steps as laundering, dewatering, drying, spreading, and ironing. At present, the spreading step remains yet to be automated and, therefore, must be manually carried out. Several methods and apparatuses are disclosed which enable a rectangular sheet of fabric to be spread by gripping the rectangular sheet of fabric at one corner thereof and another corner diagonals to the one corner and suspending the rectangular sheet of fabric in the shape of an inverted triangle and, after the edge of the rectangular sheet of fabric is deprived of a twist and is consequently straightened, gripping the rectangular sheet of fabric at an arbitrary corner and a point terminating an arbitrary width of an edge extended from the arbitrary corner and spreading the rectangular sheet of fabric by means of the grips. The methods and apparatuses enable the spreading step to be automated. Thus the whole process for cleaning dirty rectangular sheets of fabric is automated by this invention.

41 Claims, 16 Drawing Sheets

METHOD AND APPARATUS FOR SPREADING A RECTANGULAR SHEET OF FABRIC

DETAILED DESCRIPTION OF THE INVENTION

1. Field of the Invention

This invention relates to a method and apparatus for automating all the steps of a process for laundering and finishing dirty rectangular sheets of fabric at a plant such as the laundry.

2. Background Art

Heretofore at the laundry, it has been customary to receive a heap of dirty rectangular sheets of fabric, deprive the sheets of dirt at a laundering step for laundering or cleaning the sheets collectively with water or a detergent, then introduce the laundered or cleaned sheets into a dewatering step to dewater the sheets with a dewatering device, subsequently convey the dewatered sheets to a drying and disentangling step to dry the moist sheets and, at the same time, disentangle the sheets which have been entangled into a crumpled mass, and heap the sheets which have been disentangled. For the purpose of extracting one of the sheets from the heap and ironing it, this sheet must be supplied to an ironing device as held in a spread state with the opposite edges (sides) thereof neatly parallelled.

It has been further customary, therefore, to spread manually the sheets which have been disentangled, supply the spread sheets to an edge parallelling step and, with the aid of an edge parallelizing device, parallel the edges to the device, introduce the sheets with the parallelled edges into an ironing step and subject them to a finish ironing, fold the finish ironed sheets at a folding step, wrap the folded sheets at a wrapping step, and put the wrapped sheets to temporary storage prior to delivery.

For laundering and finishing the sheets of fabric, these sheets are required to undergo the steps mentioned above. In the conventional process for finishing laundered rectangular sheets of fabric, the laundering, dewatering, drying, disentangling, edge parallelling, ironing, folding, wrapping, and storing steps have been already mechanized and have been performed by the use of relevant devices without requiring any manual work. The step for spreading sheets between the drying and disentangling step and the edge parallelling step or the ironing step, however, has defied mechanization because the sheets by nature are supple and liable to collapse. At this step, therefore, several employees are engaged to perform the works of extracting individual sheets one by one from the heap, disentangling them, seeking out one corner of each sheet and the edge of the sheet extending from this corner or the corner of the sheet adjacent thereto, taking firm hold thereof, spreading the relevant sheets, and supplying the spread sheets to the edge parallelling device or the ironing device at the subsequent step.

Since these works compel the employees to bear the pain of hard labor under the adverse environment of high temperature and high humidity, they suffer from poor operational efficiency and boost the cost of operation. Since the spreading step which forms part of the whole process of laundry relies on such manual works, the whole process of laundering dirty sheets of fabric and finishing the laundered sheets cannot be automated. This fact poses the problem of interrupting any attempt at realizing an unattended operation of the laundry under an adverse environment.

SUMMARY OF THE INVENTION

This invention has an object of realizing unattended operation of the laundry as a plant and automation of the whole process of a series of steps for laundering dirty sheets of fabric and finishing the laundered sheets by providing a method and apparatus for the work of spreading sheets of fabric at one step in a series of steps ranging from laundering dirty sheets through finishing laundered sheets, namely the step for taking firm grip of one sheet out of a heap of sheets, suspending the sheet, spreading this sheet, and supplying the spread sheet to a device at the next step.

For accomplishing the object mentioned above, such concrete spreading means as will be cited herein below are provided for the spreading step which comprises picking up one of a heap of sheets of fabric which have been laundered, dewatered, dried, and disentangled, taking firm grip of one arbitrary corner part of the sheet together with the point (portion) of the sheet terminating an arbitrary width of one edge thereof extending from the one corner or another corner part adjacent across the edge to the one corner.

A first chuck (a sheet gripping member) which is vertically reciprocated by and along an elevating column takes firm grip of one of the heap of rectangular sheets of fabric. When the first chuck is moved upward along the elevating column to suspend the sheet, the sheet hangs down under its own weight. So long as the sheet is not entangled, the corner part of the sheet separated by the largest distance from the point of grip (the corner itself or the portion near the corner) assumes the position of the lowermost end of the suspended sheet. The sheet is placed in a device adjoining the elevating column and serving to extract the corner part of the sheet. A second chuck then takes firm grip of the one corner part of the sheet located at the lowermost end thereof and the first chuck looses the sheet.

The sheet hangs down under its own weight from the second chuck and, as a result, the lowermost end thereof constitutes itself the corner part which is diagonal to the corner part already gripped by the second chuck. The device for extracting the corner part of the sheet extracts the diagonal corner part and a third chuck takes firm grip of this diagonal corner part. When the second and the third chuck are laterally moved in the horizontal direction to stretch the sheet, the sheet is folded along the diagonal line connecting the corner parts gripped by the second and the third chuck and caused to hang down in the shape of an inverted triangle. From this state, the sheet is supplied to each of the first through the fifth spreading means to be described below.

In the first means for spreading a rectangular sheet of fabric, the second and the third chuck are caused to take firm grip of one corner of the sheet and the corner diagonal thereto and hang the sheet down in the shape of an inverted triangle, then the second and the third chuck are moved onto a rectangular mounting stand so as to lay the sheet folded in the shape of an inverted triangle on the mounting stand, and the second and the third chuck are moved on the mounting stand so as to drag the sheet thereon. A fulcral post for inhibiting the movement of the sheet is disposed on the central line of the mounting stand so that the second and the third chuck may be parallelly moved in the areas on the mounting stand divided by the central line.

At the same time that the folding edge of the sheet collides against the fulcral post, one of the two chucks is caused to looses the sheet and the other chuck alone is left continuously dragging the sheet. During the continued movement of the sheet, the fulcral post imparts on the sheet a gathering action such that the sheet may advance toward a line sensor which is disposed across the paths for travel of the chucks extending parallelly to the central line on the mounting stand. When the line sensor detects one edge of the sheet, the movement of the chucks or the movement of the sheet is stopped.

Thereafter, the chuck still keeping grip of the sheet is caused to loose the sheet. Another chuck which is adapted to move in the direction perpendicular to the central line on the mounting stand takes firm grip of one corner part of the sheet together with the point of the sheet terminating an arbitrary width of one edge thereof extending from the one corner and suspends and spreads the sheet.

In the second means for spreading a rectangular sheet of fabric, the second and the third chuck take firm grip of one corner part of the sheet together with another corner part thereof diagonal to the one corner part, fold the sheet in the shape of an inverted triangle, open the doubled parts of the folded and suspended sheet and straighten the folding edge. A rotary arm is rotated and approximated in the direction of the edge of the sheet. Another chuck adapted to slide on the rotary arm takes firm grip of one corner of the sheet together with a point of the sheet terminating an arbitrary width of one edge thereof extending from the one corner.

The rotary arm is attached to rotary shafts which are disposed near members for gripping the mutually diagonal corner parts of the sheet and connected to a servo motor which is set rotating by a command from a control device adapted to effect necessary control in response to a signal from a sensor for detecting the position of the edge of the sheet. The rotary arm is meshed with a toothed wheel, a clutch, a universal joint, etc. so as to produce a three-dimensional rotation both vertically and laterally. The chuck which is slidable on the rotary arm is so constructed that the positions at which the chuck takes firm grip of the sheet are suitably determined by the movement of itself proportionate to the size of the edge of the sheet.

When the edge of the sheet is gripped and the mutually diagonal corners of the sheet are loosed, the chuck of the rotary arm takes firm grip of the corner of the rectangular sheet of fabric together with the point of the sheet terminating an arbitrary width of one edge thereof extending from the one corner and suspends and spreads the sheet.

In the third means for spreading a rectangular sheet of fabric, longitudinal rails are disposed on the mounting stand as extended in the longitudinal direction along the opposite lateral edges of the upper side of the mounting stand, lateral rails are disposed so as to be moved on the left longitudinal rail and extended in the lateral direction, and a left chuck adapted to take firm grip of one corner part of the sheet together with the neighborhood of the corner part diagonal to the one corner is disposed so as to be moved in the lateral direction on the lateral rails and to be moved longitudinally and laterally on the mounting stand in response to the movement of the lateral rails in the longitudinal direction on the left longitudinal rail. A right chuck adapted to take firm grip of one corner part of the sheet is disposed so as to be quickly moved longitudinally on the right longitudinal rail. The left chuck and the right chuck are interconnected through the medium of a telescopic link bar.

A sensor for discerning the fact that the edge of the sheet has been straightened is disposed on the mounting stand below the right longitudinal rail. A sensor for implementing the operation of the left and the right chuck and a control device therefor are disposed. A chuck which is adapted to take firm grip of one corner of the sheet together with a point of the sheet terminating an arbitrary width of an edge extending from the corner and then move the sheet is provided and operated to spread the sheet.

In the fourth means for spreading a rectangular sheet of fabric, the second and the third chuck take firm grip of one corner of the sheet together with another corner diagonal to the one corner, suspend the sheet in the shape of an inverted triangle, and then move the suspended sheet to above the front side of the mounting stand disposed inside a base stand. The second and the third chuck are attached to a bridge member which is disposed astride the left and the right longitudinal rail laid along the upper lateral edges of the base stand as extended in the longitudinal direction. The bridge member is attached to a drive device formed of such transmitting means as a chain or a belt passed round such rotary means as a sprocket or a wheel disposed on the shaft of a motor and is consequently enabled to be moved by the rotation of the motor on the longitudinal rails in the longitudinal direction of the base stand.

The mounting stand is provided near the middle thereof with lateral rails laid laterally across the mounting stand and is also provided with a fourth chuck adapted to move on the lateral rails and a sensor adapted to detect the edge of the sheet on the lateral rails. It is further provided with a control device for controlling the movement of the chuck in response to a signal from the sensor. The fourth chuck takes firm grip of one corner of the sheet diagonal to the one corner of the sheet mentioned above and suspends and spreads the sheet.

In the fifth means for spreading a rectangular sheet of fabric, the second and the third chuck take firm grip of one corner of the sheet together with another corner diagonal to the one corner, suspend the sheet in the shape of an inverted triangle, then open the skirt of the suspended rectangular sheet and take firm grip of one part of an arbitrary side (edge) of the sheet, and loose the corner part on the gripped part side to hang the rectangular sheet of fabric down. The chucks move the sheet in the ensuant state to a pair of laterally symmetric mounting stands adapted to move in the lateral direction and disposed flush with each other. This fifth means is provided with a sensor adapted to discern the fact that the lower edge of the suspended sheet has been straightened. The chucks loose the sheet at the time that the sensor discerns the fact that the lower edge of the sheet has been straightened on the mounting stands.

The opposite lateral edges of the sheet mounted on the left and the right mounting stand are severally moved toward the centers of the mounting stands by the movement of the mounting stands each formed of a belt conveyor or roller. Corner sensors for detecting the opposite corners of the lower edge of the sheet are disposed at an equal distance from the centers of the left and the right mounting stand. The left and the right mounting stand are made to stop their movement when the opposite corners of the lower edge of the sheet are detected by the corner sensors. The chucks take firm grip of the opposite corners of the sheet separated by an equal distance from the centers of the mounting stands and suspend and spread the sheet.

Owing to the means for spreading the sheet described above, this invention automates continuous operation of a series of steps comprising a step for placing a multiplicity of dirty rectangular sheets of fabric in a washing machine and washing them therein, a step for dewatering the laundered sheets, a step for drying and disentangling the moist sheets, a step for taking firm grip of one of the heap of sheets and spreading the sheet, a step for straightening one edge of the spread sheet parallelly to the axis of the apparatus, a step for ironing the sheet, a step for folding the sheet, and a step for wrapping the folded sheet and putting the wrapped sheet to temporary storage in all possible selected sequences or combinations.

Operation

Owing to the constructions described above, the means for spreading the sheet mentioned above fulfill the following functions.

The first means for spreading a rectangular sheet of fabric takes firm grip of mutually diagonal corner parts of the rectangular sheet and spreads the sheet in the lateral direction, folds the sheet along the diagonal line as an edge, hangs the folded sheet down from the edge, lays the suspended sheet on a mounting stand, and drags the sheet as laid thereon. It then moves the chucks so as to inhibit the advance of the middle point of the edge of the sheet from the ensuant state, loose the grip of the sheet on one side thereof, and drag the sheet by the grip of the corner on the other side.

Since the part of the sheet on the farther side from the middle point, therefore, is inhibited from advancing by the fulcral post disposed as a movement inhibiting member at the middle point, the sheet is moved around the fulcral post as though it were slid thereon from the one side to the other side. As a result, the part of the sheet on the one side in effect is pushed from behind by the part of the sheet on the other side and the whole of the sheet is slid askew as dragged by dint of the entanglement of the corner parts. The one edge on the one side of the sheet, therefore, is moved as turned on the mounting stand around the entanglement of the corner parts and then parallelled to the center line of the mounting stand.

After the edge of the sheet has been parallelled to the center line, the chucks are driven out in the lateral direction perpendicular to the center line and caused to take firm grip of the edge. Since the chucks consequently take firm grip of the edge evenly at the corner part and the point terminating an arbitrary width of an edge extending from the corner, the center of gravity of the sheet falls on the side on which the point on the edge is gripped. The edge suspended from the gripped corner part hangs down vertically under its own weight and the sheet is consequently spread.

The second means for spreading a rectangular sheet of fabric is provided with a rotary arm incorporating therein a chuck and having the center of rotation thereof on an extension of the diagonal line of the rectangular sheet of fabric the mutually diagonal corner parts of which are gripped by the chuck. The means takes firm grip of the diagonal corner parts of the sheet, suspends the sheet in the shape of an inverted triangle, opens the skirt of the suspended sheet, relieves the sheet of the folded state, sets the rotary arm rotating along the inclination of an arbitrary edge of the sheet, and causes the chuck attached to the rotary arm to take firm grip of a corner of the sheet and a point terminating an arbitrary width of an edge extending from the corner and suspend the sheet. Since the center of gravity of the sheet consequently falls below the arbitrary point on the edge, the weight solely of the edge hanging down from the gripped corner is exerted on the edge. The suspended edge, therefore, is straightened vertically and the sheet is spread.

The third means for spreading a rectangular sheet of fabric causes the right chuck adapted to move in the longitudinal direction on the mounting stand to renew the grip of one corner part of the sheet which has been gripped thence by the second chuck and the left chuck adapted to move in both the lateral direction and the longitudinal direction of the mounting stand to renew the grip of the neighborhood of another corner part diagonal to the one corner part of the sheet which has been gripped thence by the third chuck. Thereafter, it moves the right chuck rapidly toward the rear side of the mounting stand and, at the same time, moves the left chuck slowly toward the rear side and simultaneously toward the right. As a result, the whole sheet is spread in the shape of a triangle and laid on the surface of the mounting stand, slid horizontally toward the right, rotated around the right chuck as the center, and moved toward the rear side.

When, in consequence of this rotation, one edge of the sheet is likewise rotated about the right chuck as the center and the straight line of the one edge of the sheet is parallelled to the line of movement of the right chuck, namely the right longitudinal rail, the sensor discerns this fact and the two chucks are moved in the directions perpendicular to the lateral edge of the mounting stand and then caused to take firm grip of a corner part of the sheet and a point terminating an arbitrary width of an edge extending from the corner, suspend the sheet, and spread the sheet.

The fourth means for spreading a rectangular sheet of fabric causes the second and the third chuck to take firm grip of mutually diagonal corner parts of the sheet and then moves the second chuck toward the right to stretch the sheet. The sheet is folded along the diagonal line connecting the gripped corners as the edge, spread in the shape of an inverted triangle, and suspended. With the sheet in the ensuant state, the second and the third chuck are moved onto the mounting stand disposed in the front part of the interior of the framework of the base stand and moved continuously on the mounting stand so as to lay the sheet thereon.

While the sheet is in the process of moving on the mounting stand, the third chuck looses the grip and the second chuck still holding firm grip on the sheet is moved on the mounting standing so as to drag the sheet therein. When the corner part of the sheet adjacent to the corner part of the sheet still gripped by the second chuck crosses a groove serving as a path for movement of a fourth chuck, the sensor discerns this fact, consequently causes the second chuck to stop its movement and the fourth chuck to move toward the right and take firm grip of the corner part, and then causes the second and the fourth chuck to move toward the left and consequently take firm grip of one corner of the sheet and another corner diagonal to the one corner, suspend the sheet outside the mounting stand, and spread it.

The fifth means for spreading a rectangular sheet of fabric takes firm grip of an arbitrary edge of the sheet at the positions separated by an equal distance from the two corners sharing the edge. The gripped positions of the sheet are based on the idea that they are equidistant from the center of the edge mentioned above. In implementing this idea, the sheet is spread and laid fast on the mounting stand so as not to be fluttered. The sheet is placed evenly relative to the laterally opposite ends thereof on the mounting stand so that the opposite corners of the arbitrary edge of the sheet may be equidistant from the center of the mounting stand. This sheet is rolled in toward the center of the mounting stand so as to drag the left and the right corner toward each other.

When the left and the right corners of the edge of the sheet are brought to an equal distance from the center of the mounting stand, the left and the right chuck moving parallelly to each other at an equal distance from the center of the mounting stand take firm grip of the corner parts of the sheet and suspend the sheet. As a result, the left and the right chuck take firm grip of one corner part of the sheet together with another corner part thereof adjacent to the one corner part at the positions which are equidistant from the center of one edge of the sheet and then spread the sheet. The sheet, therefore, can be placed with the edge thereof aligned with the axial line of the apparatus.

DESCRIPTION OF PREFERRED EMBODIMENTS

Figure 1:
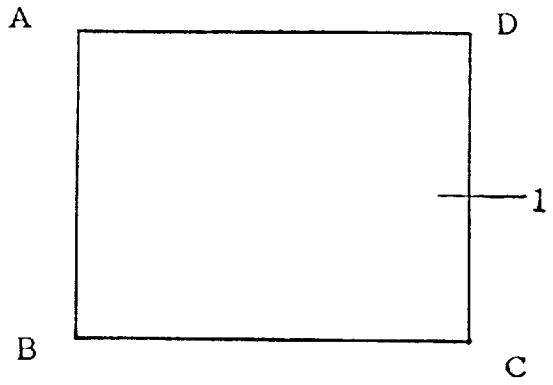
FIG. 1 is an explanatory diagram showing a rectangular sheet of fabric in a spread state.

Now, the working examples of this invention will be described below with reference to the accompanying drawings.

For the sake of the description, it is assumed that a mounting stand 8 is directed as shown in the drawings and that the position at which a sheet 1 is placed before it is moved on the mounting stand 8 falls on the front side and the left and the right side are referred to relative to the front surface of the mounting stand 8.

At a laundry, a multiplicity of dirty sheets of fabric in need of cleaning are placed all at once into a washing machine and laundered therein. Since these sheets of fabric are washed as rotated inside the washing machine, they are entangled with one another. At the step for dewatering, therefore, the washed sheets in an entangled state are dewatered. Thus, the laundered sheets are tightly entangled and compressed into a mass. For the sake of efficiently drying and ironing the laundered sheets and finishing them into clean sheets, therefore, it is necessary that the entangled laundered sheets be loosed so as to permit extraction of the sheets one by one from the mass. Thus, the mass of entangled laundered sheets is thrown into a rotary drum type cloth disintegrating machine and then left rolling inside the rotary drum. During this treatment, the mass of the entangled sheets is loosed and converted into an aggregate of distinctly separated sheets.

The sheets which have been loosed apart are extracted from the disintegrating machine, transported on a conveyor to a spreading device, and piled up in a feed part of the spreading device.

As shown in FIG. 1, A, B, C, and D denote the four corners of each of the rectangular sheets of fabric 1 which have been transported to and piled up in the feed part of the spreading device. The series of operations which will be described herein below are carried out in response to commands issued from relevant sensors and control devices.

Figure 2:
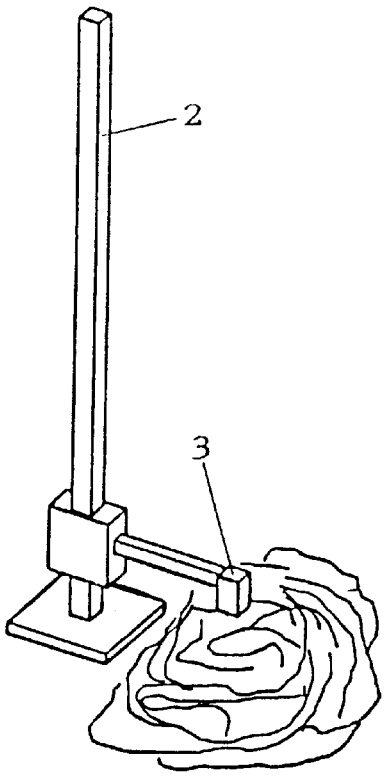
FIG. 2 is a conceptual diagram showing an example of the elevating column as held at a position for gripping a rectangular sheet of fabric from a heap of such sheets of fabric.

With reference to FIG. 2, a first chuck 3 adapted to be vertically reciprocated through the medium of an elevating column 2 above the heap of sheets 1 takes firm grip of one sheet 1 and moves it upward.

Figure 3:
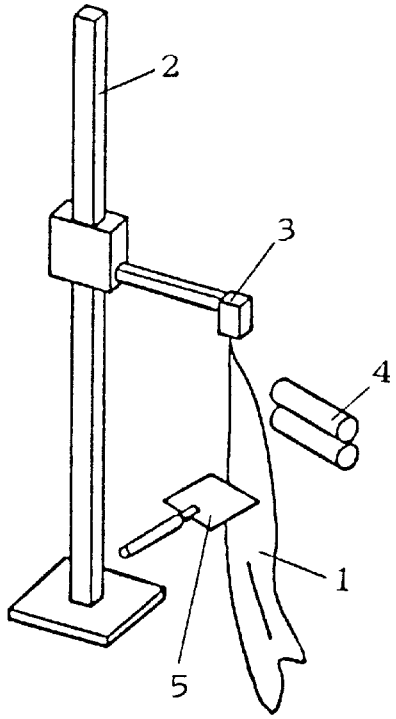
FIG. 3 is a conceptual diagram showing the example as held at a position for picking up the rectangular sheet of fabric and causing the sheet to be nipped by a vertical pair of rollers.

With reference to FIG. 3, when the sheet 1 suspended from the first chuck 3 arrives at the nipping position of a vertical pair of nipping rollers 4 of a corner drawing device disposed above and adapted to draw the corner part A of the sheet 1, a pushing plate 5 is moved in the direction of the vertical pair of rollers 4 so as to force part of the sheet 1 into the gap between the vertical pair of rollers 4 and, at the same time, the vertical pair of rollers 4 are set rotating to draw in the sheet 1. When the sheet 1 is subsequently released from the first chuck 3, it is allowed to hang down in front of the vertical pair of rollers 4.

Figure 4:
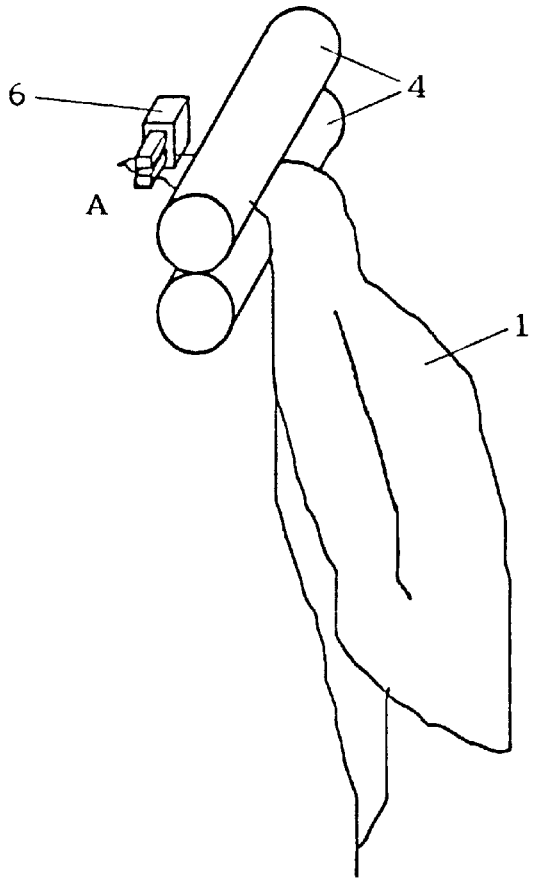
FIG. 4 is a conceptual diagram showing the example as held at a position for gripping the rectangular sheet of fabric with a second chuck.

With reference to FIG. 4, the rotation of the vertical pair of rollers 4 advances the sheet 1 to the rear side of the vertical pair of rollers 4 and one corner part A of the sheet 1 which was at the lowermost end in front of the vertical pair of rollers 4 appears in front of the vertical pair of rollers 4. At this time, the vertical pair of rollers 4 are made to stop their rotation and a second chuck 6 is moved to the front face of the vertical pair of rollers 4 and then caused to take firm grip of the one corner part A of the sheet in front of the vertical pair of rollers 4.

Figure 5:
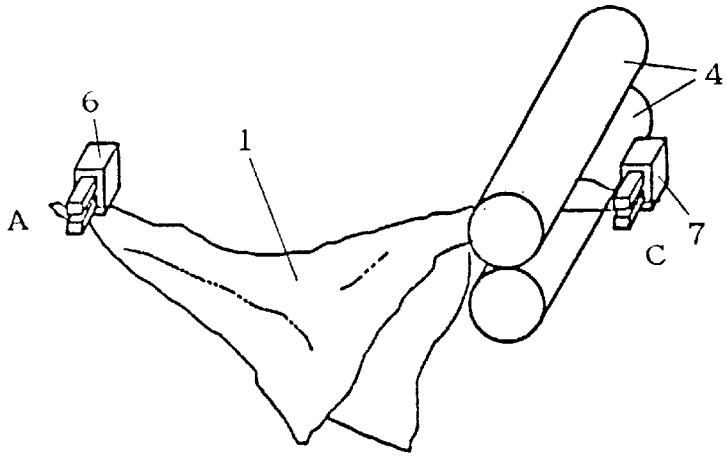
FIG. 5 is a conceptual diagram showing the example as held at a position for gripping the rectangular sheet of fabric with a third chuck.

With reference to FIG. 5, when the vertical pair of rollers 4 are rotated in the reverse direction to advance the sheet 1 to the front of the vertical pair of rollers 4, the corner part C diagonal to the corner part A of the sheet 1 which hanged down behind the vertical pair of rollers 4 and assumed the lowermost end position of the sheet appears on the rear side of the vertical pair of rollers 4. At this time, the vertical pair of rollers 4 were stopped from continuing rotation and a third chuck 7 is moved to the rear side of the vertical pair of rollers 4 and made to take firm grip of the corner part C of the sheet.

Figure 6:
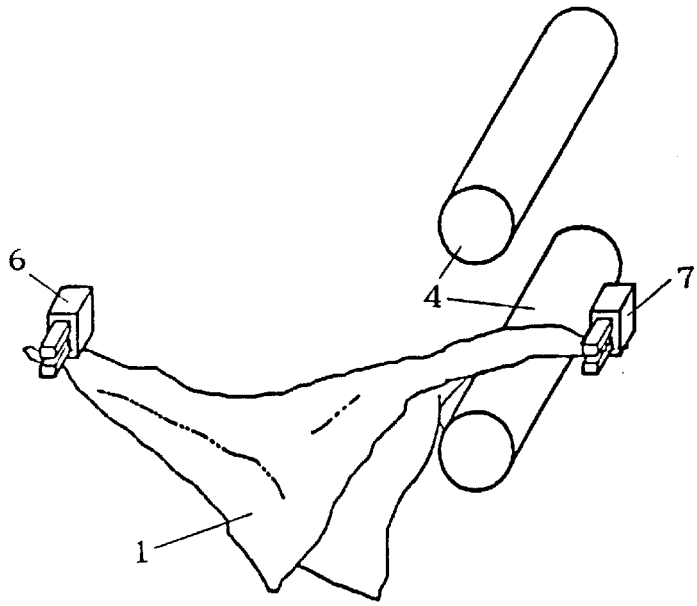
FIG. 6 is a conceptual diagram showing the example as held at a position for removing the rectangular sheet of fabric from the vertical pair of rollers.

With reference to FIG. 6, the sheet 1 is released from the nip between the vertical pair of rollers 4.

Figure 7:
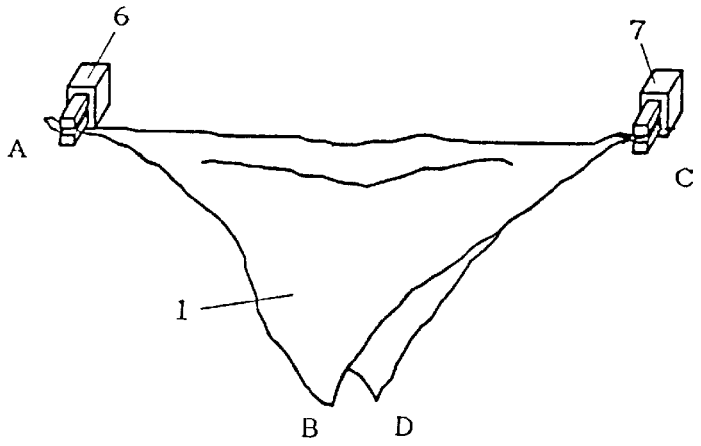
FIG. 7 is a conceptual diagram showing the example as held at a position for gripping the mutually diagonal corner parts of a rectangular sheet of fabric and stretching the sheet.

As shown in FIG. 7, the second chuck 6 and the third chuck 7 take firm grip respectively of the corner part A of the sheet 1 and the corner part C diagonal to the corner part A and suspend the sheet 1 and then the two chucks 6 and 7 are horizontally moved away from each other to stretch the sheet 1. Consequently, the sheet 1 is folded along the diagonal line interconnecting the corner A and the corner C and is ultimately suspended from the diagonal line as the edge in the shape of an inverted triangle.

Figure 8:
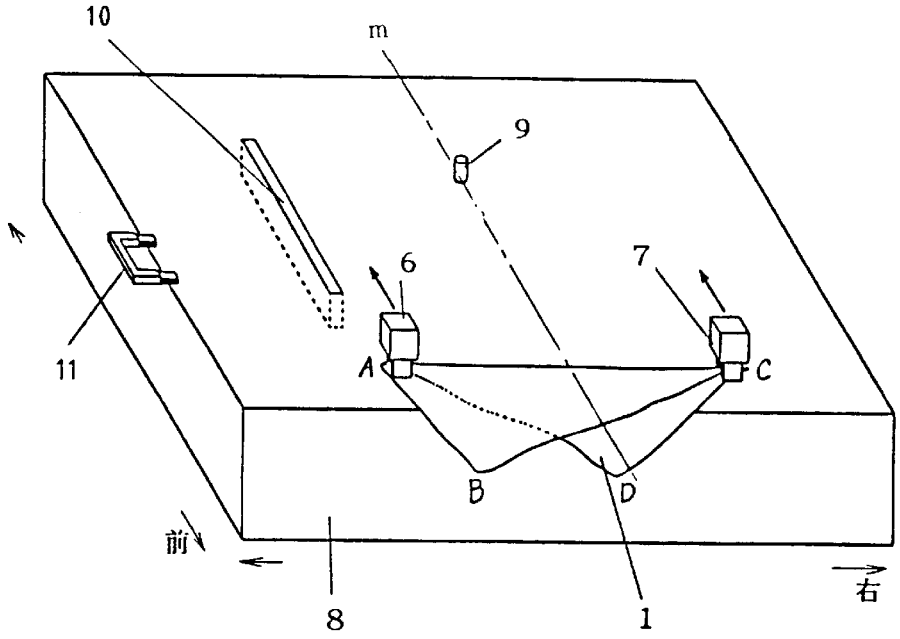
FIG. 8 is a conceptual diagram showing the example as held at a position for gripping the mutually diagonal corner parts of a rectangular sheet of fabric and moving the sheet onto a mounting stand.

An example of the first means for spreading a rectangular sheet of fabric will be described below with reference to the drawings. With reference to FIG. 8, after the second chuck 6 and the third chuck 7 have taken firm grip respectively of the corner part A and the corner part C of the rectangular sheet 1, folded the sheet along the diagonal line as the edge, and suspended the folded sheet, they move the sheet 1 to the front side of a mounting stand 8 of a rectangular shape.

Figure 9:
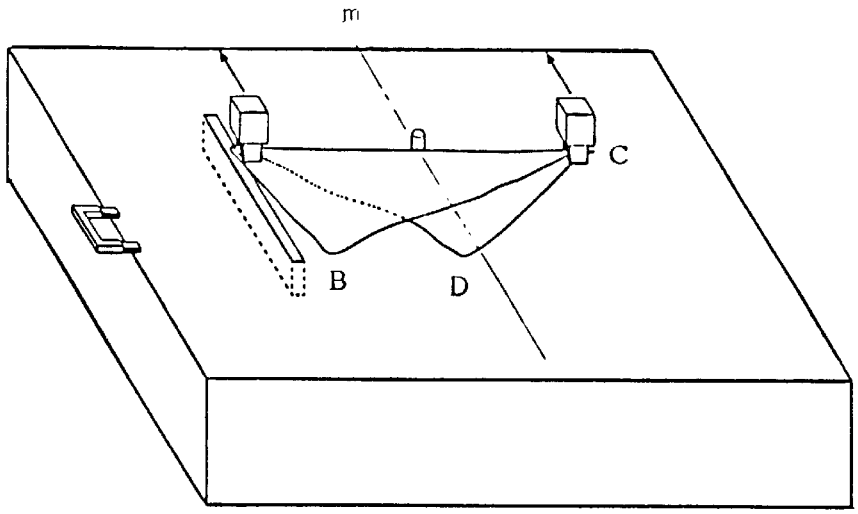
FIG. 9 is a conceptual diagram showing the example as held at a position at which the rectangular sheet of fabric is moved in a laid state on the mounting stand.

With reference to FIG. 9, after the intermediate position between the second chuck 6 and the third chuck 7 is aligned with the lateral center line m of the mounting stand 8, the second and the third chuck 6 and 7 are moved parallelly to the center line m so as to lay the rectangular sheet 1 on the mounting stand 8 and drag the sheet 1 backward.

Figure 10:
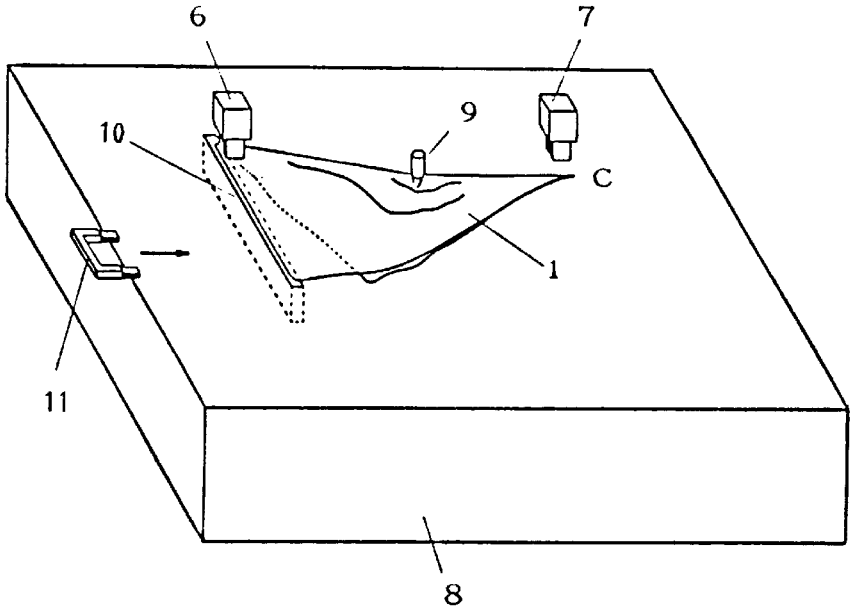
FIG. 10 is a conceptual diagram showing the example as held at a position at which the rectangular sheet of fabric is slid askew on colliding against a fulcral post on the mounting stand.

With reference to FIG. 10, as soon as the edge formed along the folding line of the sheet 1 collides against a fulcral post 9 disposed on the center line m in the direction of advance of the sheet 1 on the mounting stand 8, the third chuck 7 looses its grip and releases the corner part C of the sheet 1 and the second chuck 6 continues its grip on the corner part A of the sheet 1 and drags the sheet 1 all by itself. Then, the right side part of the sheet 1 which was on the third chuck 7 side of the sheet 1 is stopped from advancing by the fulcral post 9 and caused to move around the fulcral post toward the second chuck 6, with the result that the whole sheet is pushed and gathered as in a sliding motion toward the left and, at the same time, the edge AB (or AD) of the sheet 1 is slid askew as though it were pushed from behind by the following part of the sheet and ultimately moved toward the second chuck 6. When a line sensor 10 disposed on the path of movement of the second chuck 6 parallel in the longitudinal direction to the center line of the mounting stand 8 detects the edge AB of the sheet 1, the second chuck 6 is stopped from continuing its movement and the sheet 1 is placed on the mounting stand 8 with the edge AB of the sheet 1 aligned with the line sensor 10.

Figure 11:
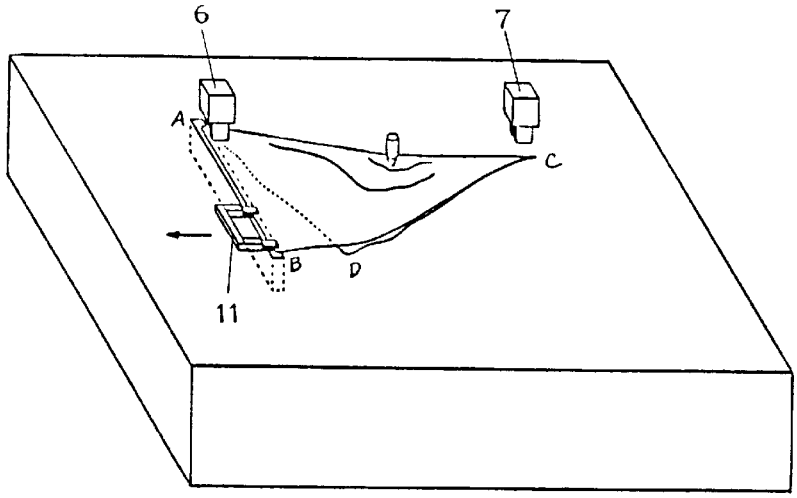
FIG. 11 is a conceptual diagram showing the example as held at a position at which one edge of the rectangular sheet of fabric is parallelized to the center line on the mounting stand.

With reference to FIG. 11, a fourth chuck 11 provided with a crotch directed toward the edge AB of the rectangular sheet 1 is advanced in a lateral direction perpendicular to the line sensor 10 and then caused to take firm grip of the corner part B (or the corner part D) and a point terminating an arbitrary width of the edge AB extending from the corner B.

Figure 12:
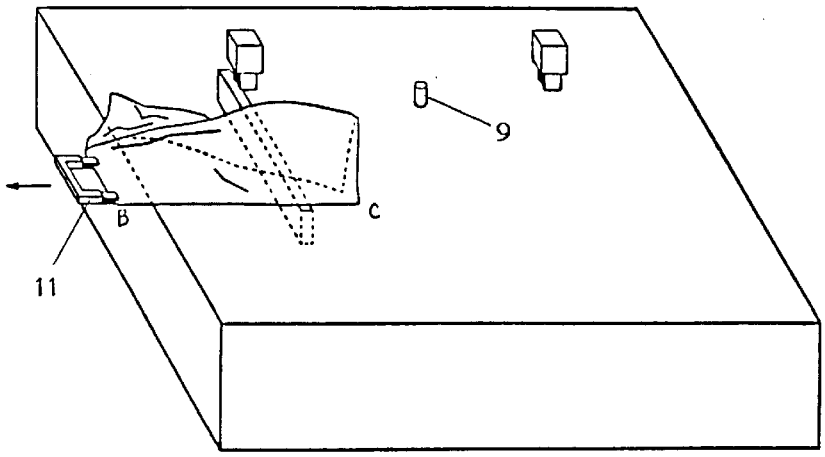
FIG. 12 is a conceptual diagram showing the example as held at a position at which the rectangular sheet of fabric is moved on the mounting stand by means of the grips at a corner part of the rectangular sheet of fabric and a point terminating an arbitrary width of an edge extending from the corner.

With reference to FIG. 12, the fourth chuck 11 provided with the crotch is moved backward to suspend the rectangular sheet 1.

Figure 13:
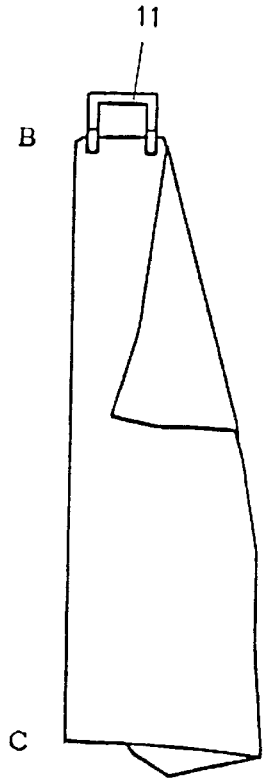
FIG. 13 is a conceptual diagram showing an example of the rectangular sheet of fabric in a state in which it is suspended by means of the grips at a corner part of the rectangular sheet of fabric and a point terminating an arbitrary width of an edge extending from the corner.

With reference to FIG. 13, the edge BC of the sheet 1 which hangs down from the grip of the corner part B by the fourth chuck 11 is stretched in a straight line under the sheet's own weight. As a result, the sheet is suspended as spread so tightly as to produce a straight folding edge. The fourth chuck 11 still suspending the sheet 1 is moved and supplied to the edge producing device at the next step.

Figure 14:
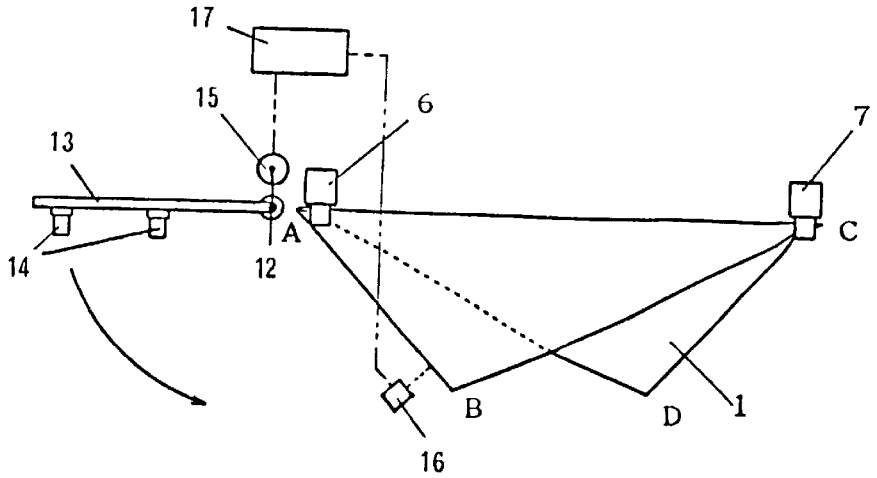
FIG. 14 is a conceptual diagram showing an example of the rectangular sheet of fabric in a state in which the sheet is gripped by a chuck attached to a rotary arm at a corner part of the rectangular sheet of fabric and a point terminating an arbitrary width of an edge extending from the corner.

A working example of the second means for spreading a rectangular sheet of fabric will be described below with reference to the accompanying drawings. With reference to FIG. 14, since the mutually diagonal corner parts A and C of the rectangular sheet of fabric 1 are gripped by the second chuck 6 and the third chuck 7, the sheet 1 is suspended as folded in the shape of an inverted triangle. A rotary arm 13 adapted to be rotated about a rotary shaft 12 as the center is disposed on an extension of the edge produced on the diagonal line of the sheet and a fifth chuck 14 adapted to slide on the rotary arm 13 is disposed thereon. The shaft of the rotary arm 13 is connected to a servo motor 15 and the servo motor 15 is rotated in response to a command from a control device 17 which is controlled by the signal of a sensor 16. The servo motor 15, through the medium of a toothed wheel and a clutch incorporated in the rotary shaft 12, causes the rotary arm 13 to be rotated three-dimensionally vertically and laterally.

With reference to FIG. 7, the rectangular sheet of fabric 1 which is suspended by the second and the third chuck 6 and 7 having respectively gripped the mutually diagonal corner parts A and C of the sheet is introduced into the spreading step which is constructed as described above. When the corner parts B and D which are hanging down coincidentally overlap at this point of time, the hanging corner parts B and D of the sheet 1 are sucked up by the use of aspirating devices, for example, to open the dangling skirt of the sheet, with the result that the sheet will be hung down while the otherwise overlapping two corner parts B and D thereof separated from each other.

Figure 15:
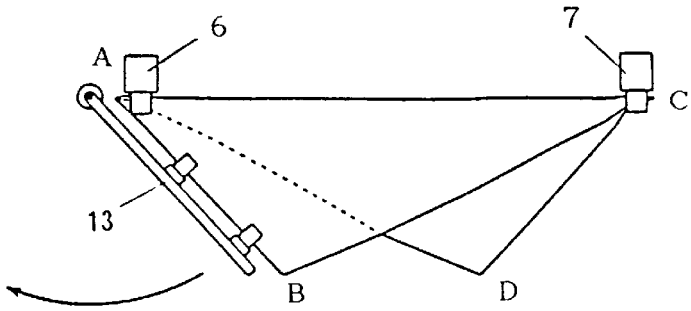
FIG. 15 is a conceptual diagram showing the example as held at a position at which the chuck attached to the rotary arm grips the sheet of fabric at a corner part of the rectangular sheet of fabric and a point terminating an arbitrary with of an edge extending from the corner.

With reference to FIG. 15, the rotary arm 13 fitted with the fifth chuck 14 and laid along the inclination of the edge of the rectangular sheet of fabric 1 is rotated and pushed out as controlled in accordance with a command of the sensor 16 serving to detect the position of the edge AB. When the rotary arm 13 is parallelled to the edge AB, it is stopped from continuing its movement. The fifth chuck 14 provided for the rotary arm 13 takes firm grip of the sheet 1 at the two points, namely the corner part B and a point terminating an arbitrary width of the edge extending from the corner B.

Figure 16:
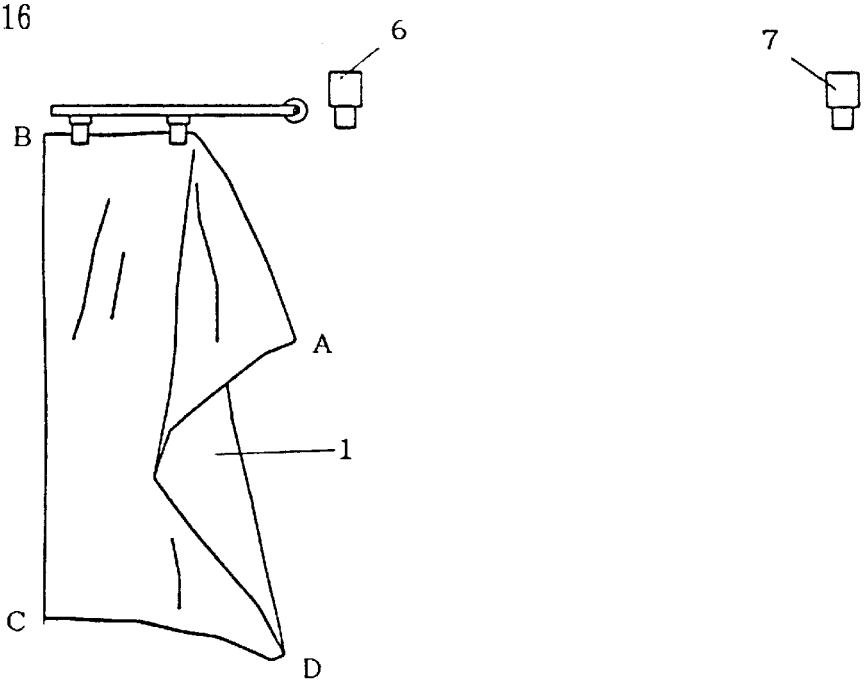
FIG. 16 is a conceptual diagram showing the example as held at a position at which the rectangular sheet of fabric is suspended as gripped by the chuck of the rotary arm.

With reference to FIG. 16, when the second and the third chuck 6 and 7 are loosed to release the corner parts A and C of the rectangular sheet of fabric 1, the sheet 1 is hung down as gripped by the fifth chuck 14 on the rotary arm 13. When the rotary arm 13 is rotated and brought to a horizontal position, the edge BC which was suspended from the corner part B of the rectangular sheet of fabric 1 assumes a vertical position. The rotary arm 13 suspending the sheet 1 is moved and supplied to the edge forming device at the next step.

A working example of the third means for spreading a rectangular sheet of fabric will be described with reference to the accompanying drawings. With reference to FIG. 7, the second chuck 6 and the third chuck 7 take firm grip respectively of the corner part A of the rectangular sheet of fabric 1 and the corner part C diagonal to the corner part A, suspend the sheet 1 as folded along the diagonal line of the gripped corners as the folding edge, and move the sheet 1 onto the mounting stand 8 of a rectangular shape.

Figure 17:
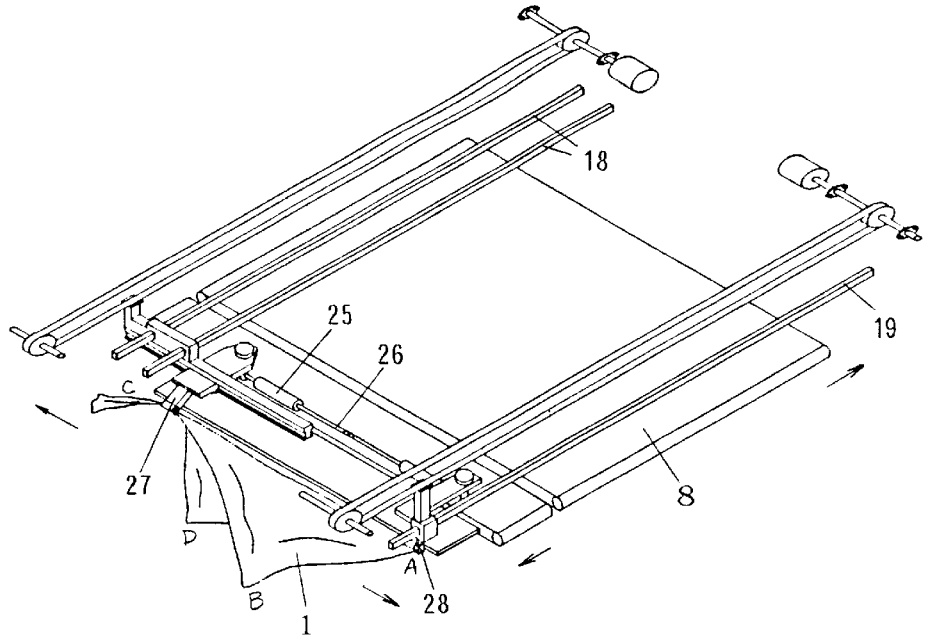
FIG. 17 is a conceptual diagram showing the example as held at a position for gripping the mutually diagonal corner parts of a rectangular sheet of fabric and moving the sheet to the front side of a mounting stand.

As shown in FIG. 17, longitudinal rails 18 and 19 are disposed on the mounting stand 8 of the rectangular shape parallelly to the lateral edges of the mounting stand 8 as laterally separated by a distance corresponding to the size of the sheet 1, a left and a right rail sliding member 20 and 21 adapted to move in the longitudinal direction on the longitudinal rails 18 and 19 are disposed respectively on the left and the right longitudinal rail 18 and 19, and the left and the right rail sliding member 20 and 21 are attached to a driving device through the medium of a chain, belt, or screw shaft.

The left rail sliding member 20 is provided with a lateral rail 24 which is extended in the lateral direction. A left chuck fixing member 22 is adapted to be moved in the lateral direction on the lateral rail 24. The left chuck fixing member 22 and a right chuck fixing member 23 which is provided for the right rail sliding member 21 are interconnected with a link bar 26 vested with a telescopic construction as by an air cylinder 25. A left and a right chuck 27 and 28 are attached respectively to the left and the right chuck fixing member 22 and 23.

When the rectangular sheet of fabric 1 having the mutually diagonal corner parts A and C thereof gripped respectively by the second chuck 6 and the third chuck 7 is moved to the front side of the mounting stand 8, the grip of the corner part A of the sheet 1 is switched from the second chuck 6 to the right chuck 28 and, at the same time, the grip of the neighborhood of the corner part C of the sheet 1 is switched from the third chuck 7 to the left chuck 27.

Figure 18:
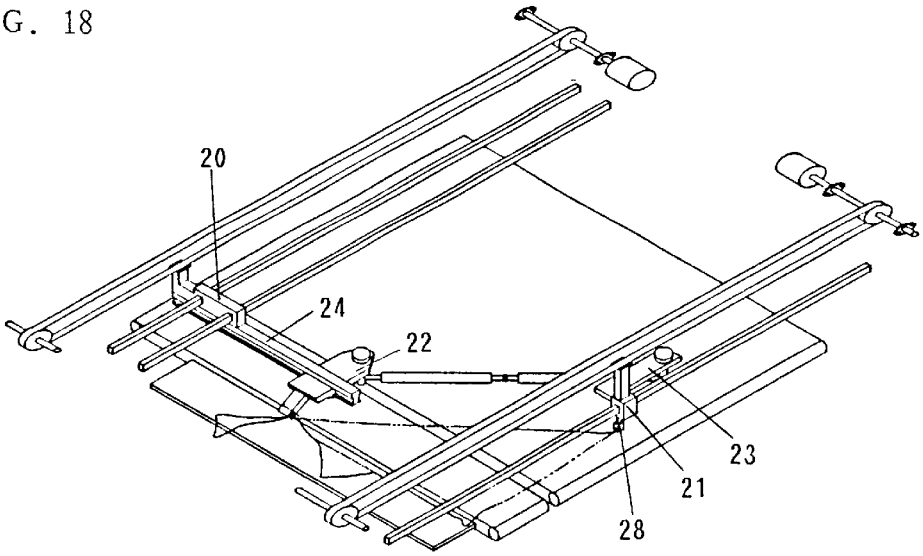
FIG. 18 is a conceptual diagram showing the example as held at a position for gripping the mutually diagonal corner parts of a rectangular sheet of fabric, moving the sheet backward as laid on the mounting stand, and straightening one edge of the sheet of fabric.

With reference to FIG. 18, the right chuck 28 which has taken firm grip of the corner part A of the sheet 1 is moved backward along the right longitudinal rail while causing the sheet 1 to be folded and laid in the shape of a triangle on the mounting stand 8 and dragged in that state. The left chuck 27 which has taken firm grip of the corner part C is moved backward on the left longitudinal rail 18 at a lower speed than that of the movement of the right chuck 28. When the length of the link bar 26 attached to the left and the right chuck fixing member 22 and 23 is fixed, the left chuck 27 is drawn toward the right by the link bar 26 and moved along the lateral rail 24 provided for the left rail sliding member 20 proportionately to the difference of distance between the backward movements of the left chuck 27 and the right chuck 28.

When the length of the link bar 26 is decreased by the air cylinder 25 provided for the link bar 26 during the movement of the sheet 1 in the lateral direction, the left chuck 27 is moved further toward the right and the corner part C of the sheet 1 gripped by the left chuck 27 is consequently pushed out toward the right. Since the sheet 1 pushed forward as described above is consequently rotated rapidly about the corner part A and slid askew on the surface of the mounting stand 8, the edge of the sheet 1 comes to the position parallel to the right longitudinal rail 19 even when the stroke of movement of the right chuck 28 on the right longitudinal rail 19 is small.

As a result, the sheet 1 laid and spread on the mounting stand 8 is moved in its entirety toward the back and the right nearly in a manner of rolling on the surface of the mounting stand 8. At the time that one edge of this sheet either reaches the right longitudinal rail 19 on the mounting stand 8 or becomes parallel thereto, the sensor discerns this fact and consequently stops the left and the right chuck 27 and 28 from continuing their movement, looses the left and the right chuck 27 and 28, and sets the sheet on the mounting stand 8.

Figure 19:
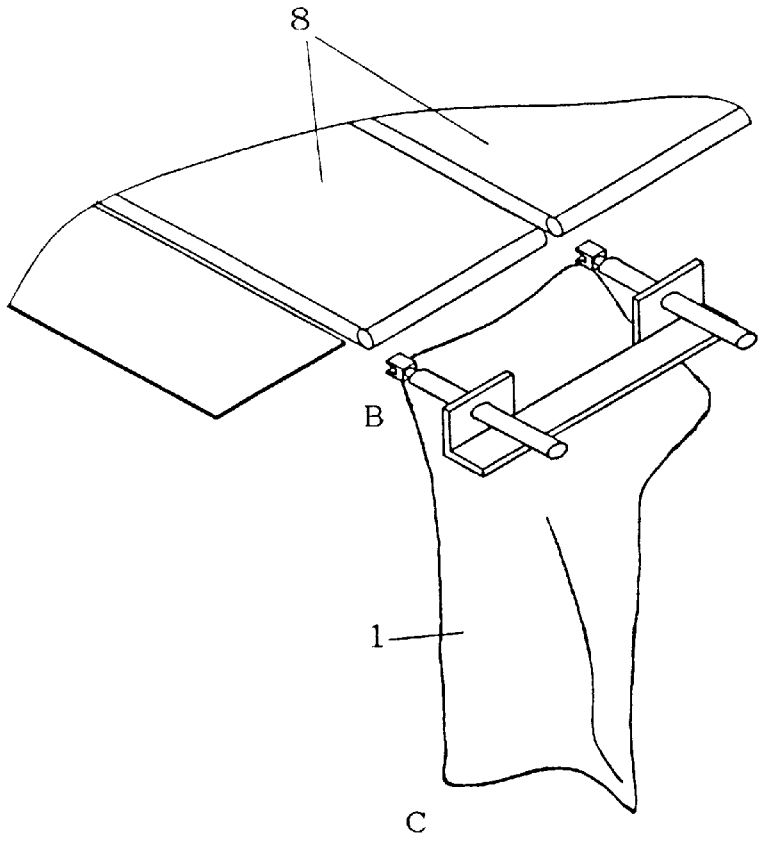
FIG. 19 is a conceptual diagram showing the example as held at a position at which the rectangular sheet of fabric is gripped at a corner part of a rectangular sheet of fabric and a point terminating an arbitrary width of an edge extending from the corner, and stretched and suspended by means of the grips.

With reference to FIG. 19, when the two chucks parted from each other and moved forward in the direction perpendicular to the right side of the mounting stand 8 take firm grip of the corner part B of the rectangular sheet 1 and one part separated from the corner part B and falling on the edge extending from the corner B, suspend the sheet 1, and stretch the sheet 1 between the grips, this sheet assumes a spread and suspended state. The two chucks in the state of suspending the sheet 1 is moved to supply the sheet to the edge forming device at the next step.

The sheet of fabric which has been supplied to the edge forming device is scooped by a triangular projected part disposed in the front part of the edge forming device, spread, derived of twist, and moved parallelly on the rectangular mounting stand formed of a horizontally laid belt. Consequently, the sheet is placed in such a manner on the mounting stand that the edges of the sheet may run parallelly to the sides of the mounting stand. When the edges of the sheet of fabric have been parallelled to each other, the sheet is forwarded to an ironing and folding device at the next step.

A working example of the fourth means for spreading a rectangular sheet of fabric will be described with reference to the accompanying drawings. With reference to FIG. 7, the second chuck 6 and the third chuck 7 take firm grip respectively of the corner parts A and C of the rectangular sheet of fabric 1, suspend the sheet in such a manner that the sheet may be folded along the diagonal line connecting the gripped corners as the edge, and move the sheet 1 toward the front of the rectangular mounting stand 8.

Figure 20:
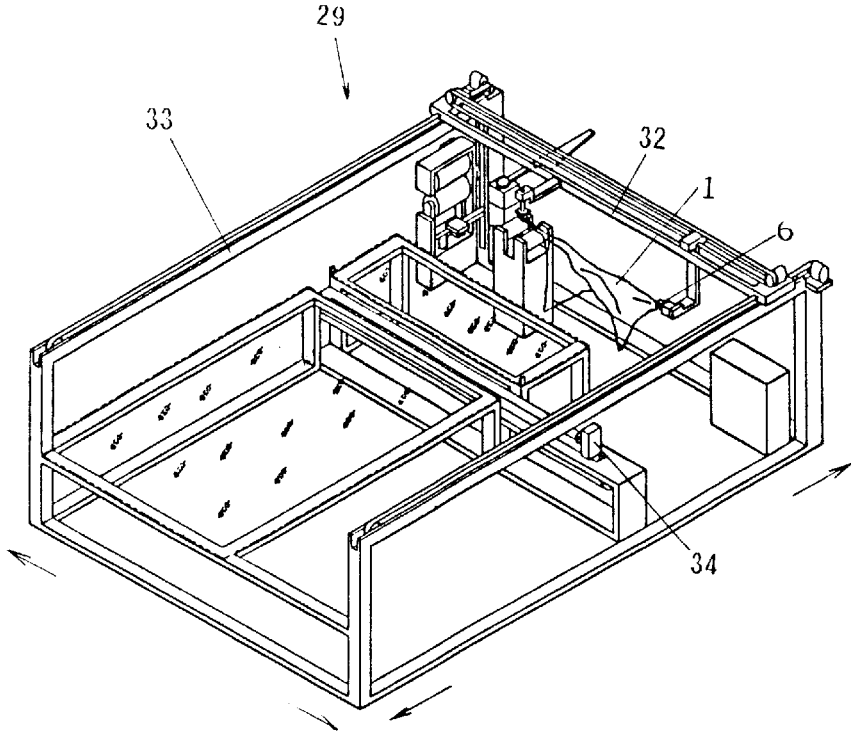
FIG. 20 is a conceptual diagram showing the example as held at a position for gripping the mutually diagonal corner parts of a rectangular sheet of fabric and moving the sheet to the front side of a mounting stand.

As shown in FIG. 20, longitudinal rails 33 extending in the longitudinal direction are disposed along the left and the right lateral edge of a base stand 29 and a bridging member 32 adapted to be moved on the left and the right longitudinal rail 33 are disposed astride the left and the right longitudinal rail 33. The mounting stand 8 is disposed inside the base stand 29 below the area for the movement of the bridging member 32. The bridging member 32 has the second chuck 6 and the third chuck 7 disposed thereon so as to be laterally moved on the bridging member 32. A chain 31 attached to a motor 30 provided for the base stand 29 and the bridging member 32 attached to the chain 31 are so disposed as to be moved in the longitudinal direction of the base stand 29 on the longitudinal rails 33 by the rotation of the motor 30. The second chuck 6 and the third chuck 7 which are attached to the bridging member 32, therefore, are supported on the longitudinal rails 33 and meanwhile enabled to take firm grip respectively of the mutually diagonal corner parts A and C of the sheet 1 and move the sheet in the longitudinal direction on the mounting stand 8.

Figure 21:
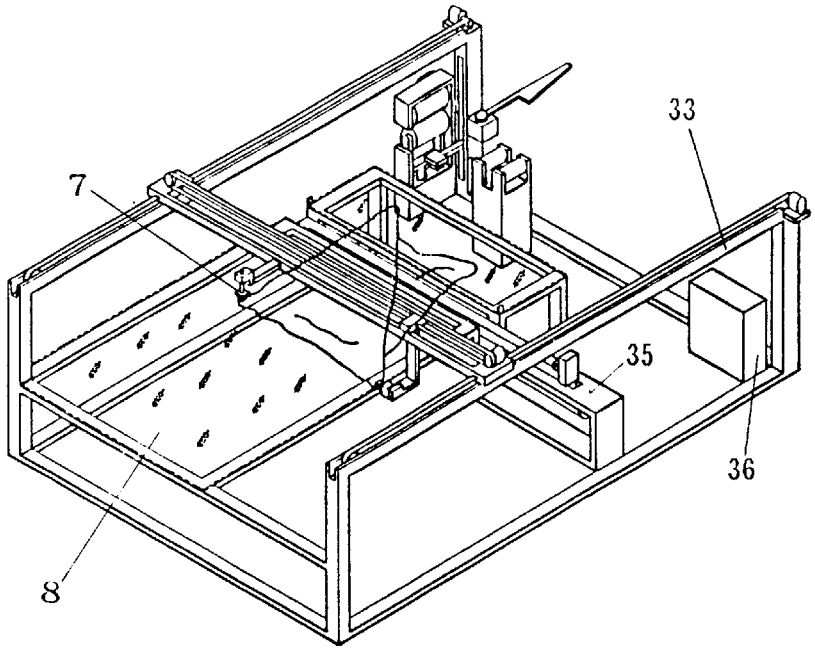
FIG. 21 is a conceptual diagram showing the example as held at a position at which the rectangular sheet of fabric is moved backward as laid and dragged on the mounting stand.

As shown in FIG. 21, when the rectangular sheet of fabric 1 having the mutually diagonal corner parts A and C thereof gripped as described above is moved backward from the front side of the mounting stand 8, it is spread in the shape of a triangle and laid and dragged in that state on the mounting stand 8.

Figure 22:
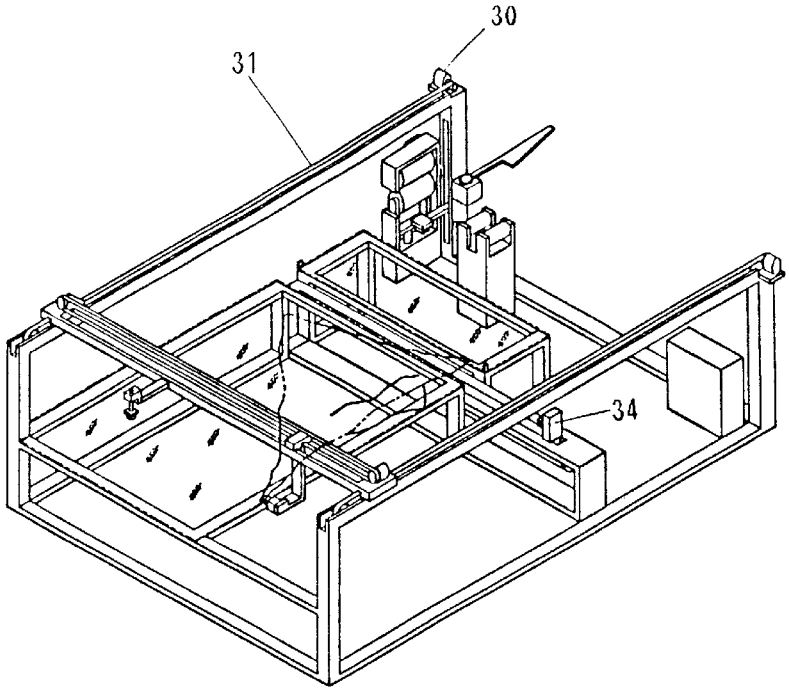
FIG. 22 is a conceptual diagram showing the example as held at a position at which one corner of a rectangular sheet of fabric adjacent to another corner thereof is detected by a sensor on the mounting stand.

With reference to FIG. 22, while the sheet 1 is being moved on the mounting stand 8, the third chuck 7 still gripping the corner part C of the sheet 1 is loosed to release the corner part C and the second chuck 6 is allowed to continue its grip of the sheet 1 and moved backward while dragging the sheet on the mounting stand 8, with the result that the sheet 1 is dragged backward nearly in a manner of being rotated about the grip of the second chuck 6 as the fulcrum. When the corner part A of the sheet 1 and the corner part B (or D) adjacent thereto which have been gripped by the second chuck 6 appear on lateral rails 35 adapted to move a sixth chuck 34 in the lateral direction, the sensor discerns this fact and, in response to the command from a control device 36, stops the motor 30 of the longitudinal drive device from continuing its rotation. As a result, the second chuck 6 is stopped from continuing its movement.

Figure 23:
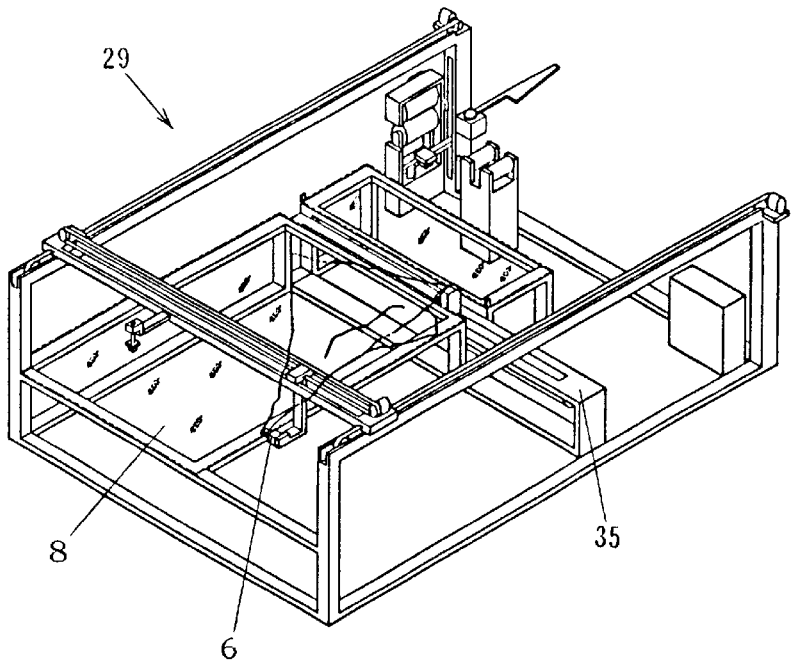
FIG. 23 is a conceptual diagram showing the example as held at a position at which one corner of a rectangular sheet of fabric and another corner thereof adjacent to the one corner are gripped on the mounting stand.

As shown in FIG. 23, the sixth chuck 34, in response to a command from the control device 36, moves toward the right on the lateral rails 35 and takes firm grip of the corner part of the sheet 1 which has ceased its movement on the lateral rails 35. As a result, the corner part A and the corner part B of the sheet 1 assume the state of being gripped respectively by the second chuck 6 and the sixth chuck 34.

Figure 24:
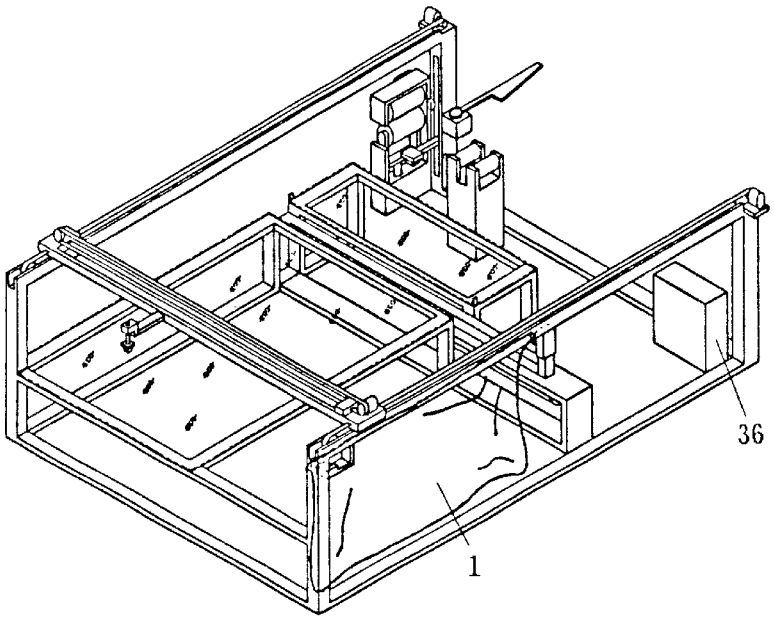
FIG. 24 is a conceptual diagram showing the example as held at a position at which the rectangular sheet of fabric is gripped at one corner of the sheet and another corner thereof adjacent to the one corner and stretched and suspended by means of the grips.

With reference to FIG. 24, when the second chuck 6 and the sixth chuck 34 in the state mentioned above are moved toward the left, the sheet 1 departs from the upper side of the mounting stand 8 and assumes a state of being spread as suspended from the corner parts A and B gripped by the second chuck 6 and the sixth chuck 34. The sheet in this spread state is supplied to the next step.

Figure 25:
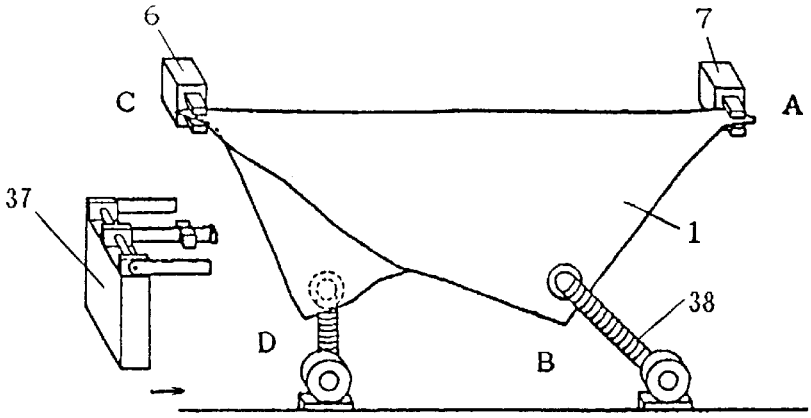
FIG. 25 is a conceptual diagram showing the example as held at a position at which the rectangular sheet of fabric is gripped at mutually diagonal corner parts thereof and the corner parts suspended from the grips are spread out.

A working example of the fifth means for spreading a rectangular sheet of fabric will be described below with reference to the accompanying drawings. With reference to FIG. 25, when the second and the third chuck 6 and 7 have taken firm grip respectively of the mutually diagonal corner parts A and C of the rectangular sheet of fabric 1, the sheet 1 suspended as folded along the diagonal line of the gripped corners as the edge have the corner parts B and D and the edges thereof invariably in an overlapped state. The edges of the sheet 1 in this state are not easily gripped apart from each other. The suspended lower parts of the sheet 1, therefore, are opened by having the corner parts B and D thereof sucked from respective sides by aspirating devices 38. Then, a chuck 37 in the shape of a three-prong fork is inserted in the opened skirt of the sheet 1.

Figure 26:
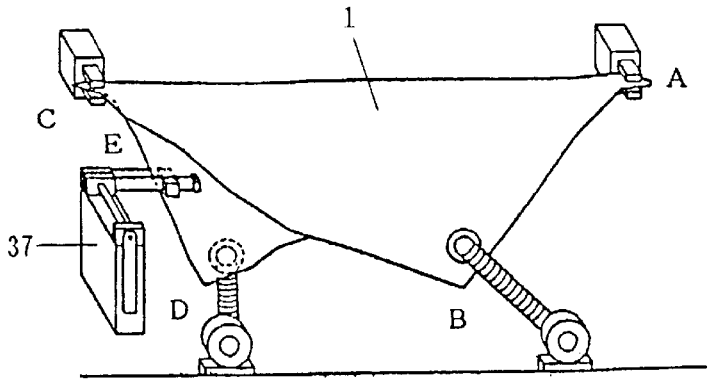
FIG. 26 is a conceptual diagram showing the example as held at a position at which a threeprong chuck is inserted into the spread skirt of a rectangular sheet of fabric.

With reference to FIG. 26, the rectangular sheet of fabric 1 is nipped in either of the two spaces separating the three prongs of the chuck 37. When the sensor discerns this fact, those prongs of the chuck 37 that have nipped the sheet 1 take firm grip of the relevant part of one edge of the sheet 1.

Figure 27:
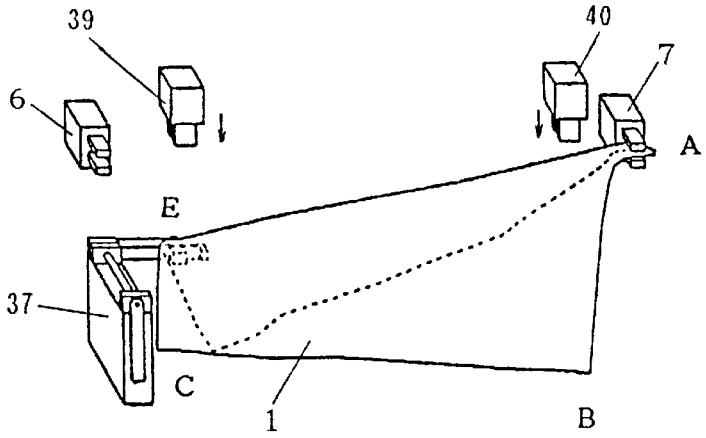
FIG. 27 is a conceptual diagram showing the example as held at a position at which a part of one edge of a rectangular sheet of fabric is gripped by a threeprong chuck.

With reference to FIG. 27, when one part E of the edge CD of the rectangular sheet of fabric 1 is nipped in the manner described above, for example, the second chuck which has taken grip of the corner part C is loosed to release the corner part C. As a result, the sheet 1 which has hung down assumes a state of being folded into two parts, trapezoid and triangle.

Figure 28:
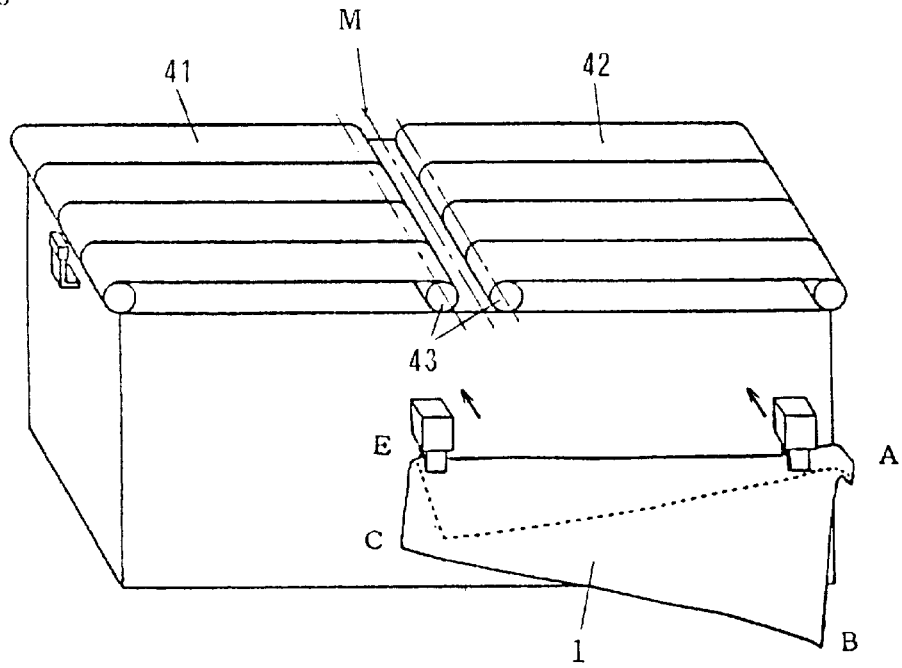
FIG. 28 is a conceptual diagram showing the example as held at a position at which a rectangular sheet of fabric is moved to a mounting stand formed of a laterally symmetrical pair of belt conveyors.

With reference to FIG. 28, a seventh and an eighth chuck 39 and 40 renew the grips of the points E and A of the rectangular sheet of fabric 1 and move the sheet 1 onto the mounting stand which is formed of a laterally symmetric pair of belt conveyors 41 and 42 laid horizontally.

Figure 29:
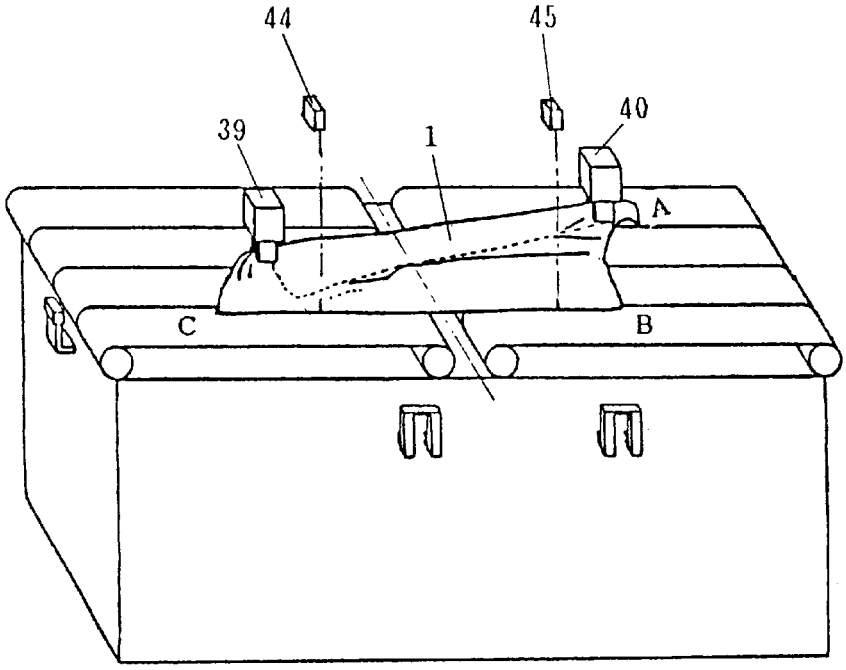
FIG. 29 is a conceptual diagram showing the example as held at a position at which a rectangular sheet of fabric is placed on a mounting stand formed of belt conveyor in such a manner that one edge of the sheet falls on a line perpendicular to the central axial line of the mounting stand.

With reference to FIG. 29, a left and a right lower side sensor 44 and 45 are disposed at two points falling within a range narrower than the width of the sheet on the lines perpendicular to the axial lines of drive rollers 43 for the left and the right belt conveyor 41 and 42. The lower edge CB on the trapezoidal part side of the suspended rectangular sheet of fabric 1 is moved on the mounting stand formed of the left and the right bent conveyor 41 and 42. The seventh chuck 39 is stopped from continuing its movement when the lower edge CB comes to the position of the left lower side sensor 44. The eighth chuck 40 is stopped from continuing its movement when the lower edge CB of the sheet 1 comes to the position of the right lower side sensor 45. Thereafter, by removing the seventh and the eighth chuck 39 and 40 from the sheet 1, the folded sheet 1 is set in place with the lower edge CB of the trapezoidal part thereof aligned to the line perpendicular to the axial lines of the drive rollers 43 for the left and the right belt conveyor 41 and 42.

Figure 30:
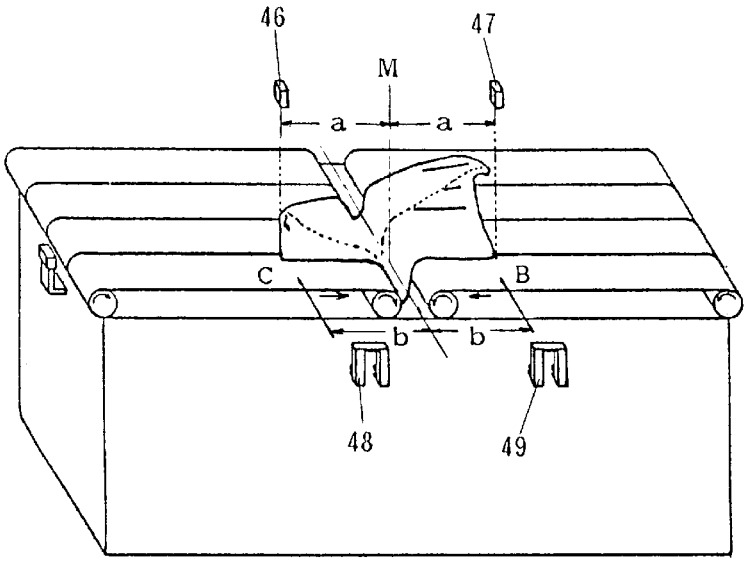
FIG. 30 is a conceptual diagram showing the example as held at a position at which two opposite corner parts of one edge of a rectangular sheet of fabric are separated by an equal distance from the central axial line of the mounting stand formed of belt conveyors.

With reference to FIG. 30, after the seventh and the eighth chuck 39 and 40 are removed from the rectangular sheet of fabric 1, corner sensors 46 and 47 are disposed at a left and a right position separated by an equal distance, a, from the central axial line (center of the mounting stand) M relative to which the left and the right belt conveyor 41 and 42 are symmetrical. The left and the right belt conveyor 41 and 42 are revolved toward the central axial line M until the corner C and the corner B of the sheet of fabric 1 respectively reach the positions of the left and the right corner sensors 46 and 47. The left and the right belt conveyor 41 and 42 are severally stopped from continuing their revolution when the corner C and the corner B of the sheet of fabric 1 respectively come to the positions of the left and the right corner sensors 46 and 47. At this time, the corner C and the corner B of the sheet of fabric 1 are at an equal distance, a, from the central axial line M.

Figure 31:
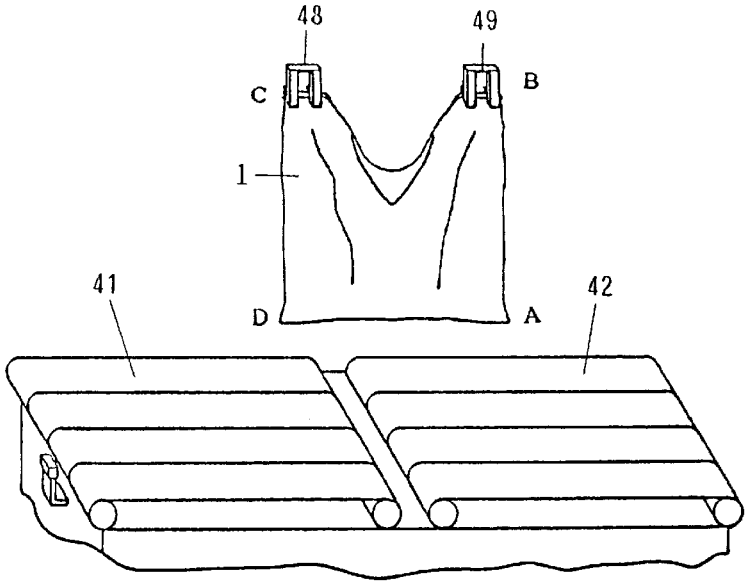
FIG. 31 is a conceptual diagram showing the sample as held at a position at which one edge of a rectangular sheet of fabric is suspended by a crotched chuck.

With reference to FIG. 31, a left and a right crotch chuck 48 and 49 disposed at symmetrical positions separated by an equal distance from the central axial line M for the left and the right belt conveyor 41 and 42 are caused to take firm grip respectively of the neighborhoods of the corners C and B of the sheet 1. In other words, the left and the right crotch chuck 48 and 49 take firm grip of the edge CB of the sheet 1 at the positions which are separated by an equal distance from the center of the edge CB of the sheet 1.

After the left and the right crock chuck 48 and 49 take firm grip of the edge CB of the rectangular sheet of fabric 1 and suspend and spread the sheet 1, they depart from the left and the right belt conveyor 41 and 42. A chuck which is provided with a claw adapted to enter the space between the prongs of the crotch chuck moving on the rails renews the grip of the sheet 1. The chuck which has spread and suspended the sheet of fabric 1 is moved so as to supply the sheet to the device at the next step, with the center of the fabric aligned to that of the device.

The sheet of fabric 1 which has been spread by the means described above is folded by being forwarded through the edge forming device or the ironing device, then wrapped, and shipped out.

EFFECT OF THE INVENTION

Since this invention is constructed as described above, it manifests the following effects.

It can liberate the employees of a laundry from harsh labor conditions because it permits automation of the whole process of steps ranging from laundering dirty rectangular sheets of fabric through finishing laundered sheets.

It can give an efficient finish to the laundered sheets because the automation permits the operation of laundering to be continued for a long period of time.

Since the mounting stand is utilized for spreading a rectangular sheet of fabric and, therefore, the sheet is allowed to assume a state of rest on the mounting stand, a corner part of the sheet and a point terminating an arbitrary width of an edge extending from the corner.

In the method and apparatus for spreading a rectangular sheet of fabric by gripping the opposite corner parts of one edge of the sheet separated by an equal distance from the center of the edge, since the sheet can be easily adjusted to the axial line of the device at the following step and the edges of the sheet can be accurately aligned to each other, the sheet may be supplied directly to the ironing device without going through the edge forming step.

FIG. 1 is an explanatory diagram showing a rectangular sheet of fabric in a spread state.

FIG. 2 is a conceptual diagram showing an example of the elevating column as held at a position for gripping a rectangular sheet of fabric from a heap of such sheets of fabric.

FIG. 3 is a conceptual diagram showing the example as held at a position for picking up the rectangular sheet of fabric and causing the sheet to be nipped by a vertical pair of rollers.

FIG. 4 is a conceptual diagram showing the example as held at a position for gripping the rectangular sheet of fabric with a second chuck.

FIG. 5 is a conceptual diagram showing the example as held at a position for gripping the rectangular sheet of fabric with a third chuck.

FIG. 6 is a conceptual diagram showing the example as held at a position for removing the rectangular sheet of fabric from the vertical pair of rollers.

FIG. 7 is a conceptual diagram showing the example as held at a position for gripping the mutually diagonal corner parts of a rectangular sheet of fabric and stretching the sheet.

FIG. 8 is a conceptual diagram showing the example as held at a position for gripping the mutually diagonal corner parts of a rectangular sheet of fabric and moving the sheet onto a mounting stand.

FIG. 9 is a conceptual diagram showing the example as held at a position at which the rectangular sheet of fabric is moved in a laid state on the mounting stand.

FIG. 10 is a conceptual diagram showing the example as held at a position at which the rectangular sheet of fabric is slid askew on colliding against a fulcral post on the mounting stand.

FIG. 11 is a conceptual diagram showing the example as held at a position at which one edge of the rectangular sheet of fabric is parallelized to the center line on the mounting stand.

FIG. 12 is a conceptual diagram showing the example as held at a position at which the rectangular sheet of fabric is moved on the mounting stand by means of the grips at a corner part of the rectangular sheet of fabric and a point terminating an arbitrary width of an edge extending from the corner.

FIG. 13 is a conceptual diagram showing an example of the rectangular sheet of fabric in a state in which it is suspended by means of the grips at a corner part of the rectangular sheet of fabric and a point terminating an arbitrary width of an edge extending from the corner.

FIG. 14 is a conceptual diagram showing an example of the rectangular sheet of fabric in a state in which the sheet is gripped by a chuck attached to a rotary arm at a corner part of the rectangular sheet of fabric and a point terminating an arbitrary width of an edge extending from the corner.

FIG. 15 is a conceptual diagram showing the example as held at a position at which the chuck attached to the rotary arm grips the sheet of fabric at a corner part of the rectangular sheet of fabric and a point terminating an arbitrary with of an edge extending from the corner.

FIG. 16 is a conceptual diagram showing the example as held at a position at which the rectangular sheet of fabric is suspended as gripped by the chuck of the rotary arm.

FIG. 17 is a conceptual diagram showing the example as held at a position for gripping the mutually diagonal corner parts of a rectangular sheet of fabric and moving the sheet to the front side of a mounting stand.

FIG. 18 is a conceptual diagram showing the example as held at a position for gripping the mutually diagonal corner parts of a rectangular sheet of fabric, moving the sheet backward as laid on the mounting stand, and straightening one edge of the sheet of fabric.

FIG. 19 is a conceptual diagram showing the example as held at a position at which the rectangular sheet of fabric is gripped at a corner part of a rectangular sheet of fabric and a point terminating an arbitrary width of an edge extending from the corner, and stretched and suspended by means of the grips.

FIG. 20 is a conceptual diagram showing the example as held at a position for gripping the mutually diagonal corner parts of a rectangular sheet of fabric and moving the sheet to the front side of a mounting stand.

FIG. 21 is a conceptual diagram showing the example as held at a position at which the rectangular sheet of fabric is moved backward as laid and dragged on the mounting stand.

FIG. 22 is a conceptual diagram showing the example as held at a position at which one corner of a rectangular sheet of fabric adjacent to another corner thereof is detected by a sensor on the mounting stand.

FIG. 23 is a conceptual diagram showing the example as held at a position at which one corner of a rectangular sheet of fabric and another corner thereof adjacent to the one corner are gripped on the mounting stand.

FIG. 24 is a conceptual diagram showing the example as held at a position at which the rectangular sheet of fabric is gripped at one corner of the sheet and another corner thereof adjacent to the one corner, and stretched and suspended by means of the grips.

FIG. 25 is a conceptual diagram showing the example as held at a position at which the rectangular sheet of fabric is gripped at mutually diagonal corner parts thereof and the corner parts suspended from the grips are spread out.

FIG. 26 is a conceptual diagram showing the example as held at a position at which a three-prong chuck is inserted into the spread skirt of a rectangular sheet of fabric.

FIG. 27 is a conceptual diagram showing the example as held at a position at which a part of one edge of a rectangular sheet of fabric is gripped by a three-prong chuck.

FIG. 28 is a conceptual diagram showing the example as held at a position at which a rectangular sheet of fabric is moved to a mounting stand formed of a laterally symmetrical pair of belt conveyors.

FIG. 29 is a conceptual diagram showing the example as held at a position at which a rectangular sheet of fabric is placed on a mounting stand formed of belt conveyor in such a manner that one edge of the sheet falls on a line perpendicular to the central axial line of the mounting stand.

FIG. 30 is a conceptual diagram showing the example as held at a position at which two opposite corner parts of one edge of a rectangular sheet of fabric are separated by an equal distance from the central axial line of the mounting stand formed of belt conveyors.

FIG. 31 is a conceptual diagram showing the sample as held at a position at which one edge of a rectangular sheet of fabric is suspended by a crotched chuck.

What is claimed is:

1. A method for spreading a rectangular sheet of fabric (1) comprising a spreading step for gripping one of a heap of laundered sheets of fabric (1) and spreading the gripped sheet, said spreading step comprising forming one corner part of the gripped sheet of fabric (1) and suspending said sheet by means of an arbitrary width of an edge of said sheet by utilizing said corner part, wherein said arbitrary width of said edge is the width of one part of the edge in the neighborhood of one corner part.

2. The method according to claim 1, wherein the formation of said corner part is attained by forcing said sheet of fabric (1) through the gap between a pair of rollers (4).

3. The method according to any of claims 1 and 2, wherein said width of one part of said edge is the part of one edge of said sheet of fabric (1) that has produced linearity on a mounting stand (8).

4. The method according to claim 1, wherein said corner formation comprises gripping one of said heap of rectangular sheets of fabric (1) and suspending said gripped sheet, then causing one part of said sheet (1) to be nipped between a vertical pair of rollers (4) and renewing the grip of said sheet (1), setting said vertical pair of rollers (4) rotating, causing one corner part (A) of said sheet (1) which was at the lowermost end on the front side of said vertical pair of rollers (4) to be gripped in front of said vertical pair of rollers (4), setting said vertical pair of rollers (4) rotating reversely and causing a corner part (C) diagonal to said one corner part (A) of said sheet (1) which was at the lowermost end on the rear side of said vertical pair of rollers (4) to be gripped when said corner part (C) reaches the rear side of said vertical pair of rollers (4), removing said sheet (1) from said vertical pair of rollers (4), and gripping said sheet (1) at said one corner part (A) and said corner part (C) diagonal to said one corner (A) and suspending said sheets by means of said grips.

5. The method according to any of claim 2, and 4, wherein said spreading step comprises gripping said rectangular sheet of fabric (1) at one arbitrary corner part (A) thereof and another corner part (C) diagonal to said one corner part (A), moving said sheet (1) in a state laid on said mounting stand (8), stopping the advance of the middle part of a ridge along which said sheet (1) is consequently folded in the shape of an inverted triangle and, at the same time, loosening the grip of said corner part (C) and enabling said sheet (1) to be moved by means of the grip of said corner part (A), and, after one edge (AB) of said sheet (1) is drawn toward and parallelized to a center line (m) of said mounting stand (8), gripping said sheet (1) at a corner part (B) thereof and a point terminating said arbitrary width of said edge extending from said corner (B) and stretching and spreading into a straight line said one edge of said sheet (1) in a suspended state.

6. The method according to any of claims 1, 2 and 4, wherein said spreading step comprises gripping said rectangular sheet of fabric (1) at one arbitrary corner part (A) thereof and another corner part (C) diagonal to said one corner part (A) and suspending said sheet (1) by means of said grips, causing a chuck (14) attached to a rotary arm (13) to grip the suspended sheet (1) at said corner part (B) and a point terminating said arbitrary width of said edge extending from said corner part (B) and suspend said sheet (1) by means of said grips, and stretching and spreading into a straight line said one edge of said sheet (1) in a suspended state.

7. The method according to any of claims 1, 2 and 4, wherein said spreading step comprises causing said one arbitrary corner part (A) of said rectangular sheet of fabric (1) and said corner part (C) diagonal to said one corner part (A) to be gripped respectively by a right chuck (28) adapted to be moved longitudinally on the right lateral edge on the upper part of said mounting stand (8) and a left chuck (27) adapted to be moved toward the right in the upper part of said mounting stand (8), moving said right chuck (28) quickly backward, moving said left chuck (27) slowly toward the back and the right thereby dragging said sheet (1) on said mounting stand (8) as laid thereon and straightening said one edge (AB) of said sheet (1), and then gripping said one corner part (B) of said sheet (1) and a point terminating said arbitrary width of said edge extending from said corner (B) and spreading said sheet (1) by means of said grips.

8. The method according to any of claims 1, 2 and 4, wherein said spreading step comprises gripping said sheet (1) at said one corner part (A) thereof and said another corner part (C) diagonal to said one corner part (A), moving said sheet (1) in a manner of being dragged as laid on said mounting stand (8), loosening the grip of either of said corner parts during the process of said movement, enabling said sheet (1) to be moved by means of the grip of the other corner part, and detecting said corner part adjacent to said other corner part of said sheet (1) on said mounting stand (8) and gripping the detected corner part thereby spreading said sheet (1).

9. The method according to any of claims 1, 2 and 4, wherein said spreading step comprises gripping said sheet (1) at said arbitrary one corner part (A) and an intermediate (E) of an edge extending from said corner part (C) diagonal to said one corner part (A) and suspending said sheet (1) over one pair of laterally symmetrical mounting stands (8) disposed flush with each other, placing a lower edge (CB) of said sheet (1) in a suspended state on said mounting stand (8) as aligned to the axial line thereof, causing said left and said right corner part (C, B) of said lower edge (CB) of said sheet (1) to be moved onto said pair of mounting stands (8) in such a manner that said left and said right corner part (C, B) may be equidistant from the center (M) of said pair of mounting stands (8), and then causing chucks having therebetween one same center as said center (M) of said mounting stand to grip said rectangular sheet of fabric (1) at said corner part (C) and said corner part (B) adjacent to said corner part (C) and spread said sheet (1) by means of said grips.

10. An apparatus for spreading a rectangular sheet of fabric (1) comprising an elevating column (2) provided with a chuck capable of gripping one of a heap of laundered sheets of fabric (1) and suspending the gripped sheet, a corner forming device for extracting mutually diagonal corner parts of said sheet of fabric (1) and gripping the extracted corner parts with a gripping chuck, and a spreading device for gripping said mutually diagonal corner parts of said sheet (1) with grips and spreading said sheet by means of said grips, said spreading device further comprising a suspending chuck capable of suspending said sheet (1) at a corner part (B) and a point terminating a width of one part of an edge extending from said corner part (B), and thereby spreading said sheet (1) and supplying said sheet (1) to the next step with the edges thereof aligned to each other.

11. The apparatus according to claim 10, wherein said spreading device comprises a second and a third chuck (6 and 7) capable of gripping said rectangular sheet of fabric (1) at mutually diagonal corner parts (A and C) of said sheet (1) and translating said corner parts (A and C) as separated by an equal distance from the center line (m) of said mounting stand (8), a fulcral post (9) capable of partially inhibiting the movement of said sheet (1) on the center line (m) of a mounting stand (8), a line sensor (10) capable of detecting an edge of said sheet (1) on the path of movement of a second and a third chuck (6 and 7), and a fourth chuck (11) which is the suspending chuck and is adapted to move in the lateral direction from said mounting stand (8).

12. The apparatus according to claim 10, wherein said spreading device comprises a second chuck (6) and a third chuck (7) capable of gripping said rectangular sheet of fabric (1) at said arbitrary one corner part (A) thereof and another corner part (C) diagonal to said one corner part (A) and suspending said sheet (1) by means of said grips, a rotary shaft (12) disposed in the proximity of said second chuck (6), a rotary arm (13) disposed in said rotary shaft (12) and adapted to produce a three-dimensional rotation vertically and horizontally, a fifth chuck (14) which is the suspending chuck and is adapted to be moved on said rotary arm (13), and a sensor (16) and a control device (17) capable of detecting the position of an edge of said sheet (1) and revolving said rotary arm (13) to the position of said edge.

13. The apparatus according to claim 10, wherein said spreading device comprises a left longitudinal rail (18) and a right longitudinal rail (19) extended longitudinally along left and right lateral edges in the upper part of said mounting stand (8), a right chuck (28) disposed on said right longitudinal rail (19) and adapted to grip said sheet (1) at said arbitrary one corner part (A) thereof and move said sheet (1) in the longitudinal direction on said right longitudinal rail (19), a left rail sliding member (20) disposed on said left longitudinal rail (18) and adapted to be moved in the longitudinal direction on said left longitudinal rail (18), a lateral rail (24) disposed for said left rail sliding member (20), a left chuck (27) capable of gripping said sheet (1) at said corner part (C) diagonal to said one corner part (A) of said sheet and moving said sheet (1) in the lateral direction on said lateral rail (24), and a telescopic link bar (26) for linking said left and said right chuck (27 and 28).

14. The apparatus according to claim 10, wherein said spreading device comprises longitudinal rails (33) extending in the longitudinal direction on the left and the right lateral edge of said mounting stand (8), a bridging member (32) disposed astride said left and said right rails (33) and adapted to be moved in the longitudinal direction on said left and said right rails (33), left and right chucks (6 and 7) adapted to be moved in the lateral direction on said bridging member (32), a sixth chuck (34) adapted to be moved across said mounting stand (8) and operated to grip the corner part of said sheet (1), a sensor disposed for said mounting stand (8) and adapted to detect said corner part of said sheet (1), and a control device for controlling the movement of said chucks in response to a signal generated from said sensor.

15. The apparatus according to claim 10, wherein said spreading device comprises a pair of mounting stands (8) disposed flush with each other and laterally symmetrically and adapted to be severally moved in the lateral direction, a left and a right chuck (39 and 40) adapted to grip said sheet (1) above said left and said right mounting stands (8) and move said sheet (1) parallel to said mounting stand (8), a left and a right lower side sensor (44 and 45) capable of detecting the linearity of a lower edge of said sheet (1) in a suspended state above said mounting stand (8), a left and a right corner sensor (46 and 47) for detecting the corners of said sheet (1) at positions separated by an equal distance on either side from the center (M) of said left and said right mounting stands (8), and chucks (48 and 49) capable of gripping one corner part and another corner part diagonal to said one corner part.

16. A method for spreading a rectangular sheet of fabric (1) comprising a spreading step for gripping one of a heap of laundered sheets of fabric (1) and spreading the gripped sheet, wherein said spreading step comprises gripping one of said heap of rectangular sheets of fabric (1) and suspending said gripped sheet, then causing one part of said sheet (1) to be nipped between a vertical pair of rollers (4) and renewing the grip of said sheet (1), setting said vertical pair of rollers (4) rotating, causing one corner part (A) of said sheet (1) which was at the lowermost end on the front side of said vertical pair of rollers (4) to be gripped in front of said vertical pair of rollers (4), setting said vertical pair of rollers (4) rotating reversely and causing a corner part (C) diagonal to said one corner part (A) of said sheet (1) which was at the lowermost end on the rear side of said vertical pair of rollers (4) to be gripped when said corner part (C) reaches the rear side of said vertical pair of rollers (4), removing said sheet (1) from said vertical pair of rollers (4), and gripping said sheet (1) at said one corner part (A) and said corner part (C) diagonal to said one corner (A) and suspending said sheet (1) by means of said grips.

17. The method according to claim 16, wherein said spreading step comprises gripping said rectangular sheet of fabric (1) at one arbitrary corner part (A) thereof and another corner part (C) diagonal to said one corner part (A), moving said sheet (1) in a state laid on said mounting stand (8), stopping the advance of the middle part of a ridge along which said sheet (1) is consequently folded in the shape of an inverted triangle and, at the same time, loosening the grip of said corner part (C) and enabling said sheet (1) to be moved by means of the grip of said corner part (A), and, after one edge (AB) of said sheet (1) is drawn toward and parallelized to a center line (m) of said mounting stand (8), gripping said sheet (1) at a corner part (B) thereof and a point terminating an arbitrary width of said edge extending from said corner (B) and stretching and spreading into a straight line said one edge of said sheet (1) in a suspended state.

18. The method according to claim 16, wherein said spreading step comprises gripping said rectangular sheet of fabric (1) at one arbitrary corner part (A) thereof and another corner part (C) diagonal to said one corner part (A) and suspending said sheet (1) by means of said grips, causing a chuck (14) attached to a rotary arm (13) to grip the suspended sheet (1) at said corner part (B) and a point terminating an arbitrary width of an edge extending from said corner part (B) and suspend said sheet (1) by means of said grips, and stretching and spreading into a straight line said one edge of said sheet (1) in a suspended state.

19. The method according to claim 16, wherein said spreading step comprises causing said one arbitrary corner part (A) of said rectangular sheet of fabric (1) and said corner part (C) diagonal to said one corner part (A) to be gripped respectively by a right chuck (28) adapted to be moved longitudinally on the right lateral edge on the upper part of said mounting stand (8) and a left chuck (27) adapted to be moved toward the right in the upper part of said mounting stand (8), moving said right chuck (28) quickly backward, moving said left chuck (27) slowly toward the back and the right thereby dragging said sheet (1) on said mounting stand (8) as laid thereon and straightening said one edge (AB) of said sheet (1), and then gripping said one corner part (B) of said sheet (1) and a point terminating an arbitrary width of an edge extending from said corner (B) and spreading said sheet (1) by means of said grips.

20. The method according to claim 16, wherein said spreading step comprises gripping said sheet (1) at said one corner part (A) thereof and said another corner part (C) diagonal to said one corner part (A), moving said sheet (1) in a manner of being dragged as laid on said mounting stand (8), loosening the grip of either of said corner parts during the process of said movement, enabling said sheet (1) to be moved by means of the grip of the other corner part, and detecting said corner part adjacent to said other corner part of said sheet (1) on said mounting stand (8) and gripping the detected corner part thereby spreading said sheet (1).

21. The method according to claim 16, wherein said spreading step comprises gripping said sheet (1) at said arbitrary one corner part (A) and an intermediate (E) of an edge extending from said corner part (C) diagonal to said one corner part (A) and suspending said sheet (1) over one pair of laterally symmetrical mounting stands (8) disposed flush with each other, placing a lower edge (CB) of said sheet (1) in a suspended state on said mounting stand (8) as aligned to the axial line thereof, causing said left and said right corner part (C, B) of said lower edge (CB) of said sheet (1) to be moved onto said pair of mounting stands (8) in such a manner that said left and said right corner part (C, B) may be equidistant from the center (M) of said pair of mounting stands (8), and then causing chucks having therebetween one same center as said center (M) of said mounting stand to grip said rectangular sheet of fabric (1) at said corner part (C) and said corner part (B) adjacent to said corner part (C) and spread said sheet (1) by means of said grips.

22. A method for spreading a rectangular sheet of fabric (1) comprising a spreading step for gripping one of a heap of laundered sheets of fabric (1) and spreading the gripped sheet, wherein said spreading step comprises gripping said rectangular sheet of fabric (1) at one arbitrary corner part (A) thereof and another corner part (C) diagonal to said one corner part (A), moving said sheet (1) in a state laid on said mounting stand (8), stopping the advance of the middle part of a ridge along which said sheet (1) is consequently folded in the shape of an inverted triangle and, at the same time, loosening the grip of said corner part (C) and enabling said sheet (1) to be moved by means of the grip of said corner part (A), and, after one edge (AB) of said sheet (1) is drawn toward and parallelized to a center line (m) of said mounting stand (8), gripping said sheet (1) at a corner part (B) thereof and a point terminating an arbitrary width of said ridge extending from said corner (B) and stretching and spreading into a straight line said one edge of said sheet (1) in a suspended state.

23. The method according to claim 22, wherein said spreading step comprises forming one corner part of the gripped sheet of fabric (1) and suspending said sheet by means of an arbitrary width of an edge of said sheet by utilizing said corner part.

24. The method according to claim 23, wherein the formation of said corner part is attained by forcing said sheet of fabric (1) through the gap between a pair of rollers (4).

25. A method for spreading a rectangular sheet of fabric (1) comprising a spreading step for gripping one of a heap of laundered sheets of fabric (1) and spreading the gripped sheet, wherein said spreading step comprises gripping said rectangular sheet of fabric (1) at one arbitrary corner part (A) thereof and another corner part (C) diagonal to said one corner part (A) and suspending said sheet (1) by means of said grips, causing a chuck (14) attached to a rotary arm (13) to grip the suspended sheet (1) at said corner part (B) and a point terminating an arbitrary width of an edge extending from said corner part (B) and suspend said sheet (1) by means of said grips, and stretching and spreading into a straight line said one edge of said sheet (1) in a suspended state.

26. The method according to claim 25, wherein said spreading step comprises forming one corner part of the gripped sheet of fabric (1) and suspending said sheet by means of an arbitrary width of an edge of said sheet by utilizing said corner part.

27. The method according to claim 26, wherein the formation of said corner part is attained by forcing said sheet of fabric (1) through the gap between a pair of rollers (4).

28. A method for spreading a rectangular sheet of fabric (1) comprising a spreading step for gripping one of a heap of laundered sheets of fabric (1) and spreading the gripped sheet, wherein said spreading step comprises causing said one arbitrary corner part (A) of said rectangular sheet of fabric (1) and said corner part (C) diagonal to said one corner part (A) to be gripped respectively by a right chuck (28) adapted to be moved longitudinally on the right lateral edge on the upper part of said mounting stand (8) and a left chuck (27) adapted to be moved toward the right in the upper part of said mounting stand (8), moving said right chuck (28) quickly backward, moving said left chuck (27) slowly toward the back and the right thereby dragging said sheet (1) on said mounting stand (8) as laid thereon and straightening said one edge (AB) of said sheet (1), and then gripping said one corner part (B) of said sheet (1) and a point terminating an arbitrary width of an edge extending from said corner (B) and spreading said sheet (1) by means of said grips.

29. The method according to claim 28, wherein said spreading step comprises forming one corner part of the gripped sheet of fabric (1) and suspending said sheet by means of an arbitrary width of an edge of said sheet by utilizing said corner part.

30. The method according to claim 29, wherein the formation of said corner part is attained by forcing said sheet of fabric (1) through the gap between a pair of rollers (4).

31. A method for spreading a rectangular sheet of fabric (1) comprising a spreading step for gripping one of a heap of laundered sheets of fabric (1) and spreading the gripped sheet, wherein said spreading step comprises gripping said sheet (1) at said one corner part (A) thereof and said another corner part (C) diagonal to said one corner part (A), moving said sheet (1) in a manner of being dragged as laid on said mounting stand (8), loosening the grip of either of said corner parts during the process of said movement, enabling said sheet (1) to be moved by means of the grip of the other corner part, and detecting said corner part adjacent to said other corner part of said sheet (1) on said mounting stand (8) and gripping the detected corner part thereby spreading said sheet (1).

32. The method according to claim 31, wherein said spreading step comprises forming one corner part of the gripped sheet of fabric (1) and suspending said sheet by means of an arbitrary width of an edge of said sheet by utilizing said corner part.

33. The method according to claim 32, wherein the formation of said corner part is attained by forcing said sheet of fabric (1) through the gap between a pair of rollers (4).

34. A method for spreading a rectangular sheet of fabric (1) comprising a spreading step for gripping one of a heap of laundered sheets of fabric (1) and spreading the gripped sheet, wherein said spreading step comprises gripping said sheet (1) at said arbitrary one corner part (A) and an intermediate (E) of an edge extending from said corner part (C) diagonal to said one corner part (A) and suspending said sheet (1) over one pair of laterally symmetrical mounting stands (8) disposed flush with each other, placing a lower edge (CB) of said sheet (1) in a suspended state on said mounting stand (8) as aligned to the axial line thereof, causing said left and said right corner part (C, B) of said lower edge (CB) of said sheet (1) to be moved onto said pair of mounting stands (8) in such a manner that said left and said right corner part (C, B) may be equidistant from the center (M) of said pair of mounting stands (8), and then causing chucks having therebetween one same center as said center (M) of said mounting stand to grip said rectangular sheet of fabric (1) at said corner part (C) and said corner part (B) adjacent to said corner part (C) and spread said sheet (1) by means of said grips.

35. The method according to claim 34, wherein said spreading step comprises forming one corner part of the gripped sheet of fabric (1) and suspending said sheet by means of an arbitrary width of an edge of said sheet by utilizing said corner part.

36. The method according to claim 35, wherein the formation of said corner part is attained by forcing said sheet of fabric (1) through the gap between a pair of rollers (4).

37. An apparatus for spreading a rectangular sheet of fabric (1) comprising an elevating column (2) provided with a chuck capable of gripping one of a heap of laundered sheets of fabric (1) and suspending the gripped sheet, a corner forming device for extracting mutually diagonal corner parts of said sheet of fabric (1) and gripping the extracted corner parts with a gripping chuck, and a spreading device for gripping said mutually diagonal corner parts of said sheet (1) with grips and spreading said sheet by means of said grips, and thereby spreading said sheet (1) and supplying said sheet (1) to the next step with the edges thereof aligned to each other, wherein said spreading device comprises a second and a third chuck (6 and 7) capable of gripping said rectangular sheet of fabric (1) at mutually diagonal corner parts (A and C) of said sheet (1) and translating said corner parts (A and C) as separated by an equal distance from the center line (m) of a mounting stand (8), a fulcral post (9) capable of partially inhibiting the movement of said sheet (1) on the center line (m) of said mounting stand (8), a line sensor (10) capable of detecting an edge of said sheet (1) on the path of movement of a second and a third chuck (6 and 7), and a fourth chuck (11) adapted to move in the lateral direction from said mounting stand (8) and suspend said sheet (1) at a corner part (B) and a point terminating an arbitrary width of an edge extending from said corner part (B).

38. An apparatus for spreading a rectangular sheet of fabric (1) comprising an elevating column (2) provided with a chuck capable of gripping one of a heap of laundered sheets of fabric (1) and suspending the gripped sheet, a corner forming device for extracting mutually diagonal corner parts of said sheet of fabric (1) and gripping the extracted corner parts with a gripping chuck, and a spreading device for gripping said mutually diagonal corner parts of said sheet (1) with grips and spreading said sheet by means of said grips, and thereby spreading said sheet (1) and supplying said sheet (1) to the next step with the edges thereof aligned to each other, wherein said spreading device comprises a second chuck (6) and a third chuck (7) capable of gripping said rectangular sheet of fabric (1) at said arbitrary one corner part (A) thereof and another corner part (C) diagonal to said one corner part (A) and suspending said sheet (1) by means of said grips, a rotary shaft (12) disposed in the proximity of said second chuck (6), a rotary arm (13) disposed in said rotary shaft (12) and adapted to produce a three-dimensional rotation vertically and horizontally, a fifth chuck (14) adapted to be moved on said rotary arm (13) and operated to grip said sheet (1) at a corner part (B) thereof and a point terminating an arbitrary width of an edge extending from said corner part (B), and a sensor (16) and a control device (17) capable of detecting the position of an edge of said sheet (1) and revolving said rotary arm (13) to the position of said edge.

39. An apparatus for spreading a rectangular sheet of fabric (1) comprising an elevating column (2) provided with a chuck capable of gripping one of a heap of laundered sheets of fabric (1) and suspending the gripped sheet, a corner forming device for extracting mutually diagonal corner parts of said sheet of fabric (1) and gripping the extracted corner parts with a gripping chuck, and a spreading device for gripping said mutually diagonal corner parts of said sheet (1) with grips and spreading said sheet by means of said grips, and thereby spreading said sheet (1) and supplying said sheet (1) to the next step with the edges thereof aligned to each other, wherein said spreading device comprises a left longitudinal rail (18) and a right longitudinal rail (19) extended longitudinally along the left and the right lateral edge in the upper part of said mounting stand (8), a right chuck (28) disposed on said right longitudinal rail (19) and adapted to grip said sheet (1) at said arbitrary one corner part (A) thereof and move said sheet (1) in the longitudinal direction on said right longitudinal rail (19), a left rail sliding member (20) disposed on said left longitudinal rail (18) and adapted to be moved in the longitudinal direction on said left longitudinal rail (18), a lateral rail (24) disposed for said left rail sliding member (20), a left chuck (27) capable of gripping said sheet (1) at said corner part (C) diagonal to said one corner part (A) of said sheet and moving said sheet (1) in the lateral direction on said lateral rail (24), and a telescopic link bar (26) for linking said left and said right chuck (27 and 28).

40. An apparatus for spreading a rectangular sheet of fabric (1) comprising an elevating column (2) provided with a chuck capable of gripping one of a heap of laundered sheets of fabric (1) and suspending the gripped sheet, a corner forming device for extracting mutually diagonal corner parts of said sheet of fabric (1) and gripping the extracted corner parts with a gripping chuck, and a spreading device for gripping said mutually diagonal corner parts of said sheet (1) with grips and spreading said sheet by means of said grips, and thereby spreading said sheet (1) and supplying said sheet (1) to the next step with the edges thereof aligned to each other, wherein said spreading device comprises longitudinal rails (33) extending in the longitudinal direction on the left and the right lateral edge of said mounting stand (8), a bridging member (32) disposed astride said left and said right rails (33) and adapted to be moved in the longitudinal direction on said left and said right rails (33), a left and a right chuck (6 and 7) adapted to be moved in the lateral direction on said bridging member (32), a sixth chuck (34) adapted to be moved across said mounting stand (8) and operated to grip the corner part of said sheet (1), a sensor disposed for said mounting stand (8) and adapted to detect said corner part of said sheet (1), and a control device for controlling the movement of said chucks in response to a signal generated from said sensor.

41. An apparatus for spreading a rectangular sheet of fabric (1) comprising an elevating column (2) provided with a chuck capable of gripping one of a heap of laundered sheets of fabric (1) and suspending the gripped sheet, a corner forming device for extracting mutually diagonal corner parts of said sheet of fabric (1) and gripping the extracted corner parts with a gripping chuck, and a spreading device for gripping said mutually diagonal corner parts of said sheet (1) with grips and spreading said sheet by means of said grips, and thereby spreading said sheet (1) and supplying said sheet (1) to the next step with the edges thereof aligned to each other, wherein said spreading device comprises a pair of mounting stands (8) disposed flush with each other and laterally symmetrically and adapted to be severally moved in the lateral direction, a left and a right chuck (39 and 40) adapted to grip said sheet (1) above said left and said right mounting stands (8) and move said sheet (1) parallel to said mounting stand (8), a left and a right lower side sensor (44 and 45) capable of detecting the linearity of a lower edge of said sheet (1) in a suspended state above said mounting stand (8), a left and a right corner sensor (46 and 47) for detecting the corners of said sheet (1) at positions separated by an equal distance on either side from the center (M) of said left and said right mounting stands (8), and chucks (48 and 49) capable of gripping one corner part and another corner part diagonal to said one corner part.

* * * * *